US011969067B2

(12) United States Patent
Bae et al.

(10) Patent No.: US 11,969,067 B2
(45) Date of Patent: Apr. 30, 2024

(54) HORIZONTALLY MOVABLE BOWLING BAG PROVIDING EASE OF USE AND MAINTENANCE

(71) Applicants: Sung Hwan Bae, Daegu (KR); Jae Young Bae, Daegu (KR); Si Hyeon Bae, Seoul (KR); Gang Nam Bae, Gyeonggi-do (KR)

(72) Inventors: Sung Hwan Bae, Daegu (KR); Jae Young Bae, Daegu (KR); Si Hyeon Bae, Seoul (KR); Gang Nam Bae, Gyeonggi-do (KR)

( * ) Notice: Subject to any disclaimer, the term of this patent is extended or adjusted under 35 U.S.C. 154(b) by 0 days.

(21) Appl. No.: 18/140,035

(22) Filed: Apr. 27, 2023

(65) Prior Publication Data

US 2024/0074555 A1 Mar. 7, 2024

(30) Foreign Application Priority Data

May 9, 2022 (KR) ..... 10-2022-0056900

(51) Int. Cl.

| | |
|---|---|
| ***A45C 5/14*** | (2006.01) |
| ***A45C 13/02*** | (2006.01) |
| ***A45C 13/04*** | (2006.01) |
| ***A45C 13/26*** | (2006.01) |
| ***A63B 47/00*** | (2006.01) |

(52) U.S. Cl.

CPC ..... *A45C 5/14* (2013.01); *A45C 13/02* (2013.01); *A45C 13/04* (2013.01); *A45C 13/262* (2013.01); *A63B 47/007* (2013.01); *A45C 2013/267* (2013.01)

(58) Field of Classification Search

CPC ..... A45C 5/14; A45C 13/02; A45C 13/04; A45C 13/262; A45C 2013/267; A63B 47/007; B60B 33/0007; B60B 33/001; B60B 33/0021

USPC ..... 206/315.91

See application file for complete search history.

(56) References Cited

U.S. PATENT DOCUMENTS 2,617,012 A * 11/1952 Westley ..... A63B 47/007 473/59
2,872,029 A * 2/1959 Cart ..... A63B 47/007 206/579
2,922,453 A * 1/1960 Le Goff ..... A63B 47/007 206/315.91

(Continued)

FOREIGN PATENT DOCUMENTS

KR 1020160064578 6/2016
KR 102340312 12/2021

*Primary Examiner* — Ernesto A Grano

(74) *Attorney, Agent, or Firm* — IPLA P.A.

(57) ABSTRACT

A horizontally movable bowling bag providing ease of use and maintenance, the bowling bag includes: a frame having a space defined therein to store a plurality of bowling balls; a ball support assembled to or integrally formed with the frame to support each of the plurality of bowling balls in the space; casters provided at a lower side of the frame to allow the frame to move in a horizontal direction, each of the plurality of casters comprising a coupling member removably coupled thereto so as to be exposed to an outside of the frame, a fixing boss fixed in a support hole in the frame using the coupling member, and a drive wheel coupled to a lower end of the fixing boss so as to be freely rotatable; and a handle integrally coupled to one side of the frame, the handle being configured to be adjustable in length.

14 Claims, 24 Drawing Sheets

(56) References Cited

U.S. PATENT DOCUMENTS 3,281,883 A * 11/1966 Glantz ..... A63B 47/007 15/210.1
4,066,156 A * 1/1978 Basile ..... A45C 11/00 206/315.9
5,074,571 A * 12/1991 Reese ..... B62B 1/14 D34/24
5,988,323 A * 11/1999 Chu ..... B60B 33/021 16/35 R
6,099,023 A * 8/2000 Be ..... A63B 47/007 280/655
6,109,627 A * 8/2000 Be ..... B62B 1/26 190/18 A
6,719,306 B2 * 4/2004 White ..... A63B 47/002 280/47.26
6,722,671 B2 * 4/2004 Be ..... A63B 47/007 206/315.9
D512,564 S * 12/2005 Teitloff ..... D3/257
7,707,686 B2 * 5/2010 Chou ..... B60B 33/0021 16/35 R
7,997,594 B1 * 8/2011 Mortazavi ..... B62B 1/008 206/315.9
8,684,145 B2 * 4/2014 Boukhny ..... F16D 63/00 188/68
9,603,764 B2 * 3/2017 Turturro ..... A61G 7/05
10,004,651 B2 * 6/2018 DeLuca ..... A61G 1/0275
11,413,506 B2 * 8/2022 Bae ..... A45C 13/04
11,659,906 B2 * 5/2023 Campbell ..... A45C 5/14 190/15.1
2002/0113386 A1 * 8/2002 Be ..... A63B 47/007 280/47.26
2008/0093238 A1 * 4/2008 Handelman ..... A63B 47/007 206/315.91
2008/0258540 A1 * 10/2008 Hicks ..... B60B 33/0007 16/21
2013/0049312 A1 * 2/2013 Hou ..... A63B 47/007 280/47.26
2014/0137368 A1 * 5/2014 Frame ..... B60B 33/0007 411/321
2014/0238946 A1 * 8/2014 Nally ..... A63B 47/007 211/85.7
2015/0258850 A1 * 9/2015 Schioppa ..... B60B 33/025 16/37
2016/0160897 A1 * 6/2016 Allen ..... B60B 33/0002 403/362
2020/0216104 A1 * 7/2020 Leblanc ..... B66C 23/36
2021/0052051 A1 * 2/2021 Perez ..... A45C 13/385
2021/0120953 A1 * 4/2021 Bouche ..... B60B 33/0007

* cited by examiner

HORIZONTALLY MOVABLE BOWLING BAG PROVIDING EASE OF USE AND MAINTENANCE

BACKGROUND

The present invention relates to a bowling bag that is horizontally movable in a state of storing a plurality of bowling balls, and more particularly to a horizontally movable bowling bag providing ease of use and maintenance, which is capable not only of safely transporting a plurality of bowling balls in a state of stably storing and supporting the bowling balls, but also of facilitating replacement of casters thereof, which are frequently damaged.

In general, people play golf in golf practice facilities or on golf courses. Golf has been regarded as one of the noble sports with high dignity, and therefore golfers wear appropriate golf attire and golf shoes, rather than casual clothes. Golf attire and golf shoes are respectively carried in a state of being stored in a bag and a shoe pouch, and are worn in golf practice facilities or on golf courses.

In this case, however, because golf attire and golf shoes are separately carried, the number of pieces of baggage to be carried by a golfer is large, which causes inconvenience to the golfer.

Therefore, many golfers put a shoe pouch containing golf shoes into a bag in which golf attire is contained in order to reduce the number of pieces of baggage to be carried.

However, in the case in which golf shoes are stored in a bag together with golf attire, foot odor in the golf shoes leaks through ventilation holes formed in the shoe pouch, and then clings to the golf attire, which makes the golfer feel unpleasant when wearing the golf attire and causes poor hygiene.

Korean Utility Model Registration No. 381977 discloses a golf travel bag capable of preventing the above problems. As shown in FIG. 1, the golf travel bag includes a main body 300, a suit pocket 2 provided in the main body 300 so as to be opened and closed by means of a zipper from the outside of the main body 300, a cover 200 provided on the upper side of the main body 300 so as to be opened and closed by means of a zipper, a handle 400 mounted to one side of the main body 300 and formed to be adjustable in length in a telescopic manner, casters 500 mounted to the lower side of the main body 300, and support protrusions 600 formed on the lower surface of the main body 300 at positions aligned with the casters 500.

In addition, the golf travel bag further includes a shoe pocket 6 provided in a side surface of the main body 300 to store shoes in a space defined on the inner bottom surface of the main body 300, a cover 64 provided on the side surface of the main body 300 to open and close the shoe pocket 6, the cover 64 being formed to be opened and closed by means of a zipper, a handle pocket 7 provided under the shoe pocket 6 to receive the handle 400 when the handle 400 is reduced in length in a telescopic manner, and a cover 74 provided on the side surface of the main body 300 to open and close the handle pocket 7, the cover 74 being formed to be opened and closed by means of a zipper 72. When the handle 400 is received in the handle pocket 7, the cover 74 shields the handle 400 to make the same invisible.

However, in the golf travel bag described above, the casters 500 are mounted only to one side of the lower surface of the main body 300, which causes attire organized in the suit pocket to become tangled during movement of the golf travel bag.

In addition, because the casters 500 are integrally mounted to the lower surface of the main body 300, a user experiences inconvenience of having to replace the main body 300 in the event of damage to the casters 500.

In addition, although it is possible to place a separate auxiliary bag on the main body 300 in order to carry additional articles, such as balls, the golf travel bag does not have a separate device for firmly coupling the auxiliary bag to the main body 300, and therefore it is difficult to securely fix the auxiliary bag to the main body 300.

SUMMARY OF THE INVENTION

The present invention has been made in an effort to solve the above-described problems associated with the related art, and it is an object of the present invention to provide a horizontally movable bowling bag providing ease of use and maintenance, which facilitates storage of a plurality of bowling balls, which are heavy objects, and is capable of safely loading the bowling balls therein, easily transporting the bowling balls, reliably supporting the bowling balls, and minimizing shaking of the bowling balls during movement of the bowling bag, thereby preventing overturn or non-smooth movement of the bowling bag.

In one aspect, a horizontally movable bowling bag providing ease of use and maintenance according to the present invention for accomplishing the above and other objects includes a frame having a space defined therein to store a plurality of bowling balls, a ball support assembled to or integrally formed with the frame to support each of the plurality of bowling balls in the space, a plurality of casters provided at the lower side of the frame to allow the frame to move in the horizontal direction, each of the plurality of casters including a coupling member coupled thereto so as to be exposed to the outside of the frame, each of the plurality of casters being removed from the frame when the coupling member is released, and a handle integrally coupled to one side of the frame and configured to be adjustable in length. Each of the plurality of casters includes a fixing boss supported by the frame and inserted into a support hole in the frame using the coupling member and a drive wheel connected to the fixing boss so as to be freely rotatable. The frame has a plurality of support sections integrally formed therewith, each of the plurality of support sections having a predetermined height and a predetermined width to disperse load applied to the fixing boss in the vertical direction and the horizontal direction, and the support hole is formed to a predetermined depth in the vertical direction through each of the plurality of support sections to allow the fixing boss to be inserted thereinto.

The coupling member may have a configuration selected from among a configuration in which the fixing boss has a thread formed thereon and is fixed in the support hole through engagement of a nut with the thread, a configuration in which the fixing boss has an elastic hook formed on the upper end thereof so as to be fixed in the support hole, a configuration in which the fixing boss has a pin hole formed therethrough and is fixed in the support hole through insertion of a fixing pin into the pin hole, a configuration in which the fixing boss has a ring hole formed therein and is fixed in the support hole through insertion of a fixing ring into the ring hole, and a configuration in which the fixing boss has a ring hole formed therein and is fixed in the support hole through forcible fitting of a fixing cap into the ring hole.

The frame may be made of a plastic material, and may have a hexahedral shape having an open front surface. A cover, which is made of a fabric material and has a pocket, may be coupled to the frame in a sewing manner, a zipper-coupling manner, a rivet-coupling manner, a screw-coupling manner, or a button-coupling manner. The frame may further include a storage chamber defined therein to store separate bowling supplies. Each of the plurality of support sections of the frame may be formed by protruding one side of a lower portion of the frame outwards or may be formed on an outer corner of the lower portion of the frame. The storage chamber may be integrally formed with the frame so as to be defined in the frame or may be formed so as to be mounted in the frame and to have a chamber door configured to be opened and closed from the outside of the frame.

The frame may be made of a plastic material, and may have a hexahedral shape having two open opposite side surfaces. The frame may be partitioned in the lateral direction by a partition plate integrally formed therewith on a middle portion thereof, and a cover, which is made of a fabric material and has doors and a pocket, may be coupled to the frame in a sewing manner, a zipper-coupling manner, a rivet-coupling manner, a screw-coupling manner, or a button-coupling manner. The frame may further include a storage chamber defined therein to store bowling supplies other than a bowling ball. Each of the plurality of support sections of the frame may be formed by protruding one side of a lower portion of the frame outwards or may be formed on an outer corner of the lower portion of the frame. The storage chamber may be integrally formed with the frame so as to be defined in the frame or may be formed so as to be mounted in the frame and to have a chamber door configured to be opened and closed from the outside of the frame.

In addition, the bowling bag may further include an auxiliary bag, which includes an auxiliary frame made of a plastic material and configured to store one or more bowling balls therein, a bracket coupled to the auxiliary frame, the bracket having a mounting hole formed therein to allow the handle to pass therethrough in the vertical direction, and an auxiliary cover connected to the auxiliary frame, the auxiliary cover having a door configured to be opened and closed from above or doors configured to be opened and closed from both sides of the auxiliary cover, the auxiliary cover being made of a fabric material.

In addition, the ball support may include a shaking prevention member to prevent shaking of a bowling ball. The shaking prevention member may be implemented as at least one selected from among a tension portion formed by cutting a portion of the ball support along an incision line, the tension portion having a protrusion formed on an upper surface thereof, a support belt formed to be fastened and released in order to prevent the bowling ball from escaping from the ball support in the forward direction, and a resilient support member provided on an inner side of the cover coupled to the frame.

In another aspect, the present invention provides a horizontally movable bowling bag providing ease of use and maintenance, the bowling bag including a frame having a space defined therein to store a plurality of bowling balls, a ball support assembled to or integrally formed with the frame to support each of the plurality of bowling balls in the space, a plurality of casters provided at a lower side of the frame to allow the frame to move in the horizontal direction, a handle integrally coupled to one side of the frame, the handle being configured to be adjustable in length, and an auxiliary bag. The auxiliary bag includes an auxiliary frame made of a plastic material and configured to store one or more bowling balls therein, a bracket coupled to the auxiliary frame, the bracket having a mounting hole formed therein to allow the handle to pass therethrough in the vertical direction, and an auxiliary cover connected to the auxiliary frame, the auxiliary cover having a door configured to be opened and closed from above or doors configured to be opened and closed from both sides of the auxiliary cover, the auxiliary cover being made of a fabric material.

Each of the plurality of casters may include a coupling member removably coupled thereto so as to be exposed to the outside of the frame, a fixing boss fixed in a support hole in the frame using the coupling member, and a drive wheel coupled to a lower end of the fixing boss so as to be freely rotatable. The frame may have a plurality of support sections integrally formed therewith, each of the plurality of support sections having a predetermined height and a predetermined width to disperse load applied to the fixing boss inserted into the support hole in the vertical direction and the horizontal direction, and the support hole may be formed to a predetermined depth in the vertical direction through each of the plurality of support sections to allow the fixing boss to be inserted thereinto.

In addition, the coupling member may have a configuration selected from among a configuration in which the fixing boss has a thread formed thereon and is fixed in the support hole through engagement of a nut with the thread, a configuration in which the fixing boss has an elastic hook formed on an upper end thereof so as to be fixed in the support hole, a configuration in which the fixing boss has a pin hole formed therethrough and is fixed in the support hole through insertion of a fixing pin into the pin hole, a configuration in which the fixing boss has a ring hole formed therein and is fixed in the support hole through insertion of a fixing ring into the ring hole, and a configuration in which the fixing boss has a ring hole formed therein and is fixed in the support hole through forcible fitting of a fixing cap into the ring hole.

The frame may be made of a plastic material, and may have a hexahedral shape having an open front surface. A cover, which is made of a fabric material and has a door and a pocket, may be coupled to the frame in a sewing manner, a zipper-coupling manner, a rivet-coupling manner, a screw-coupling manner, or a button-coupling manner. The frame may further include a storage chamber defined therein to store bowling supplies other than a bowling ball, and one side of the cover may be connected to the frame via a reinforcing plate provided in the frame. Each of the plurality of support sections of the frame may be formed by protruding one side of a lower portion of the frame outwards or may be formed on an outer corner of the lower portion of the frame. The storage chamber may be integrally formed with the frame so as to be defined in the frame or may be formed so as to be mounted in the frame and to have a chamber door configured to be opened and closed from the outside of the frame.

The frame may be made of a plastic material, and may have a hexahedral shape having two open opposite side surfaces. The frame may be partitioned in the lateral direction by a partition plate integrally formed therewith on a middle portion thereof, and a cover, which is made of a fabric material and has doors and a pocket, may be coupled to the frame in a sewing manner, a zipper-coupling manner, a rivet-coupling manner, a screw-coupling manner, or a button-coupling manner. The frame may further include a storage chamber defined therein to store bowling supplies other than a bowling ball. The storage chamber may be integrally formed with the frame so as to be defined in the frame or may be formed so as to be mounted in the frame and to have a chamber door configured to be opened and closed from the outside of the frame.

In addition, the ball support may include a shaking prevention member to prevent shaking of a bowling ball.

The shaking prevention member may be implemented as at least one selected from among a tension portion formed by cutting a portion of the ball support along an incision line, the tension portion having a protrusion formed on an upper surface thereof, a support belt formed to be fastened and released in order to prevent the bowling ball from escaping from the ball support in the forward direction, and a resilient support member provided on an inner side of the cover coupled to the frame.

In still another aspect, the present invention provides a horizontally movable bowling bag providing ease of use and maintenance, the bowling bag including a frame having a space defined therein to store a plurality of bowling balls, a ball support assembled to or integrally formed with the frame to support each of the plurality of bowling balls in the space, a plurality of casters provided at a lower side of the frame to allow the frame to move in the horizontal direction, each of the plurality of casters including a coupling member coupled thereto so as to be exposed to the outside of the frame, a handle integrally coupled to one side of the frame, the handle being configured to be adjustable in length, and an auxiliary bag. The auxiliary bag includes an auxiliary frame made of a plastic material and configured to store one or more bowling balls therein, a bracket coupled to the auxiliary frame, the bracket having a mounting hole formed therein to allow the handle to pass therethrough in the vertical direction, and an auxiliary cover connected to the auxiliary frame, the auxiliary cover having a door configured to be opened and closed from above or doors configured to be opened and closed from both sides of the auxiliary cover, the auxiliary cover being made of a fabric material. Each of the plurality of casters includes a fixing boss supported by the frame using the coupling member and a drive wheel connected to the fixing boss so as to be freely rotatable. The frame has a plurality of support sections integrally formed therewith, each of the plurality of support sections having a predetermined height and a predetermined width to disperse load applied to the fixing boss in the vertical direction and the horizontal direction, and a support hole is formed to a predetermined depth in the vertical direction through each of the plurality of support sections to allow the fixing boss to be inserted thereinto.

The auxiliary frame of the auxiliary bag may have fixing projections protruding from a lower surface thereof and screw holes formed in the lower surface thereof, and the frame may have grid-shaped ribs and screw holes formed in coupling bosses formed on an upper surface thereof. When the auxiliary bag is placed on the frame, the fixing projections may be supported by the grid-shaped ribs, and screws may be fastened into the screw holes in the auxiliary frame and the screw holes in the frame.

Each of the plurality of casters may be removably mounted to the frame using the coupling member exposed to the outside of the frame, and the coupling member may have a configuration selected from among a configuration in which the fixing boss has a thread formed thereon and is fixed in the support hole through engagement of a nut with the thread, a configuration in which the fixing boss has an elastic hook formed on an upper end thereof so as to be fixed in the support hole, a configuration in which the fixing boss has a pin hole formed therethrough and is fixed in the support hole through insertion of a fixing pin into the pin hole, a configuration in which the fixing boss has a ring hole formed therein and is fixed in the support hole through insertion of a fixing ring into the ring hole, and a configuration in which the fixing boss has a ring hole formed therein and is fixed in the support hole through forcible fitting of a fixing cap into the ring hole.

The frame may be made of a plastic material, and may have a hexahedral shape having an open front surface. A cover, which is made of a fabric material and has a door and a pocket, may be coupled to the frame in a sewing manner, a zipper-coupling manner, a rivet-coupling manner, a screw-coupling manner, or a button-coupling manner. The frame may further include a storage chamber defined therein to store bowling supplies other than a bowling ball. Each of the plurality of support sections of the frame may be formed by protruding one side of a lower portion of the frame outwards or may be formed on an outer corner of the lower portion of the frame. The storage chamber may be integrally formed with the frame so as to be defined in the frame or may be formed so as to be mounted in the frame and to have a chamber door configured to be opened and closed from the outside of the frame.

The frame may be made of a plastic material, and may have a hexahedral shape having two open opposite side surfaces. The frame may be partitioned in the lateral direction by a partition plate integrally formed therewith on a middle portion thereof, and a cover, which is made of a fabric material and has doors and a pocket, may be coupled to the frame in a sewing manner, a zipper-coupling manner, a rivet-coupling manner, a screw-coupling manner, or a button-coupling manner. The frame may further include a storage chamber defined therein to store bowling supplies other than a bowling ball. The storage chamber may be integrally formed with the frame so as to be defined in the frame or may be formed so as to be mounted in the frame and to have a chamber door configured to be opened and closed from the outside of the frame.

In addition, the ball support may include a shaking prevention member to prevent shaking of a bowling ball. The shaking prevention member may be implemented as at least one selected from among a tension portion formed by cutting a portion of the ball support along an incision line, the tension portion having a protrusion formed on an upper surface thereof, a support belt formed to be fastened and released in order to prevent the bowling ball from escaping from the ball support in the forward direction, and a resilient support member provided on an inner side of the cover coupled to the frame.

BRIEF DESCRIPTION OF THE DRAWINGS

The above and other objects, features, and other advantages of the present invention will be more clearly understood from the following detailed description taken in conjunction with the accompanying drawings, in which.

DETAILED DESCRIPTION OF THE INVENTION

Figure 1:
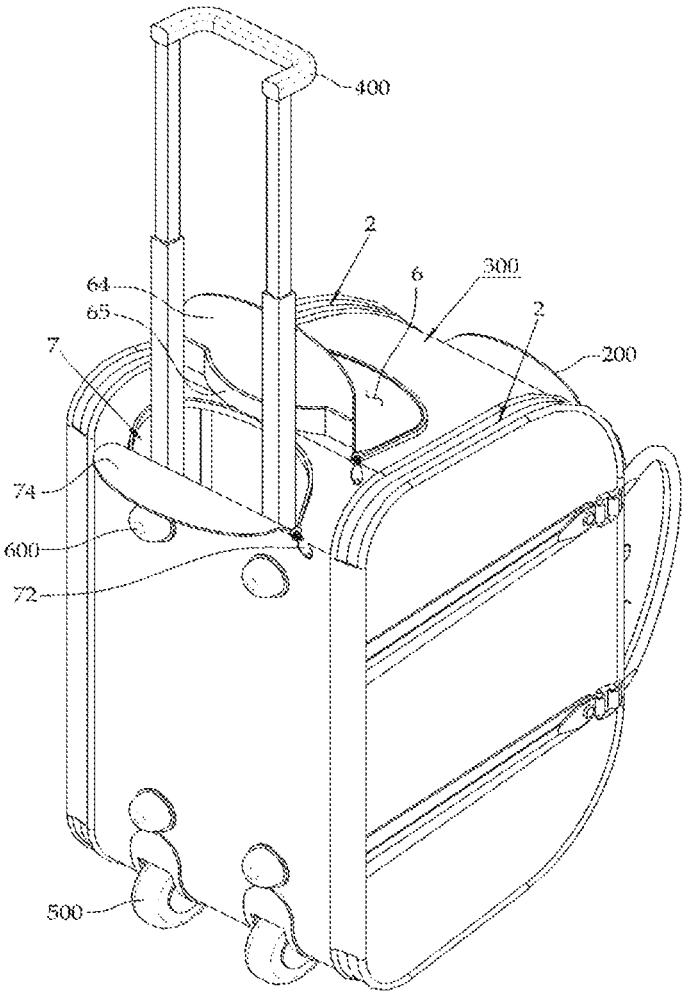
FIG. 1 Prior Art
FIG. 1 is a perspective view showing a conventional golf bag.

Hereinafter, exemplary embodiments of the present invention will be described in detail with reference to the accompanying drawings.

As shown in FIGS. 2 to 27, a bowling bag 100 of the present invention includes a frame 110 and one or more ball supports 150 provided in the frame 110.

In addition, the bowling bag 100 of the present invention includes a plurality of casters 300, which protrude downwards from the lower surface of the frame 110 so that the frame 110 is capable of horizontally moving parallel to the ground.

The frame 110 of the bowling bag 100 of the present invention has a hexahedral shape such that one or more storage spaces S for storing a bowling ball B are defined therein, and is made of a plastic material.

In this case, the frame 110 is formed as a unitary body having a hexahedral shape, and the front side or both sides thereof are open.

In the case in which the frame 110 is a side-reception-type frame, both sides of which are open, the storage space S may be partitioned into a plurality of storage spaces by one or more partition plates 139, which are integrally formed with the frame 110 so as to extend in the vertical direction.

In addition, the frame 110 may be provided with a reinforcing plate 138, which is assembled to the frame 110 in the vertical direction or the horizontal direction in order to increase assembly strength when a cover 200 is assembled to the frame 110.

In addition, the frame 110 is formed in a 90°-rotated U shape or an L shape when viewed in a side view in order to reduce the weight thereof, and the cover 200 is sewn to the frame 110 to form a hexahedral shape together with the frame 110.

The frame 110 has a plurality of grid-shaped ribs 145 integrally formed therewith on the lower surface or the upper surface thereof in order to increase the strength thereof and to reduce the weight thereof.

The cover 200 is connected to edges of the frame 110 to cover the front side or both sides of the frame 110, thereby forming a hexahedral shape overall together with the frame 110.

In this case, the cover 200 is made of a fabric material, and is connected to the front side or at least one of both sides of the frame 110. The cover 200 has a door 210 integrally formed therewith, and the door 210 is formed to be opened and closed by means of a zipper. When the door 210 is opened, the storage space S is exposed to the outside.

The cover 200, which is made of a fabric material, is connected to edges of the front side or both sides of the frame 110 in a sewing manner, a zipper-coupling manner, a rivet-coupling manner, a screw-coupling manner, a button-coupling manner, or the like.

The cover 200 has one or more auxiliary handles 280 integrally fixed thereto in a sewing manner.

In addition, the door 210 formed at the cover 200 has one or more pockets 215, which protrude outwards from the cover 200 and are formed to be opened and closed by means of a zipper or the like.

The ball support 150 of the present invention is provided in the frame 110 to support one or more bowling balls B in the horizontal direction or the vertical direction.

In addition, the ball support 150 has a concave recess formed in a support surface thereof, and the concave recess has a shape corresponding to the shape of the bowling ball. The ball support 150 includes a shaking prevention member 600 for preventing shaking of the bowling ball when the bowling bag 100 is moved horizontally.

The shaking prevention member 600 is implemented as at least one selected from among:

- a tension portion 610 formed by cutting a portion of the ball support 150 along an incision line 613 so as to be resiliently bendable relative to the portion of the ball support 150, the tension portion 610 having a protrusion 611 formed on the upper surface thereof;
- a support belt 630 formed to be fastened and released in order to prevent the bowling ball from escaping from the ball support 150 in the forward direction, the support belt 630 including a cable and a tension adjustment knob 631 to which the cable is connected; and
- a resilient support member 650 provided on the inner side of the cover 200 so as to protrude therefrom, the resilient support member 650 being made of a sponge material or the like.

The ball support 150 may be provided separately from the frame 110, and may be assembled to a fixing block 130, which is integrally formed with the frame 110 so as to protrude from the inner side of the frame 110. Alternatively, the ball support 150 may be integrally formed with the frame 110 on the inner side of the frame 110.

In this case, the tension portion 610 is formed at the ball support 150 at the time of integrally forming the ball support 150 on the inner side of the frame 110.

The support belt 630 is provided in a pair, and the pair of support belts is formed corresponding to each other so as to fix each bowling ball. The pair of support belts is provided at connection ends thereof with a hook and a latch, which are applied to safety belts or the like, so as to be connected to and disconnected from each other.

Similar to tension adjustment knobs applied to shoes or the like, the tension adjustment knob 631 is configured to rotate to pull or release the cable connected thereto, thereby adjusting the tension of the support belt 630.

The frame 110 is provided with a plurality of casters 300 on the lower surface thereof so as to be movable horizontally in the state in which the bowling ball is loaded therein. Preferably, three or four casters may be mounted to the frame 110. The frame 110 is provided with a handle 190 connected to the rear side thereof, and the handle 190 is formed such that the length thereof is adjusted in multiple stages so as to be accommodated in the frame 110 or exposed upwards from the frame 110.

Each of the casters 300 may be provided on one side thereof with a brake unit (not shown), which locks a corresponding caster to prevent the frame 110 from moving from a stationary state.

Each of the casters 300 mounted to the frame 110 includes a fixing boss 310, which is inserted into a support hole 160 in the frame 110, a coupling member 350, which is detachably coupled to the fixing boss 310 inserted into the support hole 160 to support the fixing boss 310, and a drive wheel 330, which is connected to the lower end of the fixing boss 310 so as to be freely rotatable.

The fixing boss 310 has a positioning projection 312 formed on the peripheral surface thereof, and the frame 110 has therein a positioning hole 356 formed under the support hole 160 to support the positioning projection 312. The positioning hole 356 prevents rotation of the positioning projection 312 inserted thereinto.

The coupling member 350 includes a guide ring 358, which is made of a metallic material and is disposed on the upper end of the support hole 160 to allow the fixing boss 310 to be inserted thereinto in order to prevent damage to the support hole 160 due to friction with the fixing boss 310, and a sealing cover 354, which is disposed on the upper end of the fixing boss 310 to prevent exposure of the fixing boss 310.

That is, when the fixing boss 310 is inserted into the support hole 160 formed in the frame 110, the coupling member 350, which is disposed above the support hole 160, is detachably coupled to the upper portion of the fixing boss 310 that is exposed upwards from the support hole 160.

In detail, the frame 110 has a support section 140 formed on one side thereof, and the support hole 160 is formed in the support section 140. The support section 140 is formed to have a cross-section having a predetermined height and a predetermined width so as to disperse load applied to the fixing boss 310 in the vertical direction and the horizontal direction, thereby ensuring firm coupling of the fixing boss 310.

Further, the support section 140 may be designed to disperse load applied thereto using the ribs 145 formed on the frame 110.

Preferably, the support section 140 is formed on a lower corner portion of the outer surface of the frame 110 so as to protrude outwards therefrom, like a wing of a rocket.

In detail, the support section 140 is formed by protruding one side of the lower portion of the frame 110 outwards, or is formed on the outer corner of the lower portion of the frame 110.

The coupling member 350 has a configuration selected from among:

- a configuration in which a thread is formed on the fixing boss 310 and a nut 351 is engaged with the thread to fix the fixing boss 310 in the support hole 160;
- a configuration in which an elastic hook 353 is formed on the upper end of the fixing boss 310 so as to be caught by the upper surface of the support section 140;
- a configuration in which a pin hole is formed through the fixing boss 310 and a fixing pin 355 is inserted into the pin hole to fix the fixing boss 310 in the support hole 160;
- a configuration in which a ring hole is formed in the peripheral surface of the fixing boss 310 and a fixing ring 357 is inserted into the ring hole to fix the fixing boss 310 in the support hole 160; and
- a configuration in which a ring hole is formed in the peripheral surface of the fixing boss 310 and a fixing cap 359 is forcibly fitted into the ring hole to fix the fixing boss 310 in the support hole 160.

The fixing cap 359 is made of a plastic material, and has a metallic resilient fixing piece integrally formed therewith on the inner side thereof. The fixing cap 359 is secured to the fixing boss 310 in such a manner that the resilient fixing piece thereof is forcibly fitted into the ring hole in the fixing boss 310.

In addition, the frame 110 further includes a storage chamber 360 provided therein to store bowling shoes or bowling supplies 900. The storage chamber 360 is provided in a lower side or an upper side in the frame 110 so as to be isolated from the space for loading the bowling ball therein.

The storage chamber 360 is integrally formed with the frame 110 so as to be defined in the frame 110, or is formed so as to be mounted in the frame 110. In the latter case, the frame 110 has a chamber door 361 configured to be opened and closed from the outside to enable access to the storage chamber 360.

The chamber door 361 is of a one-touch opening and closing operation type, and is coupled to the outer surface of the frame 110 so as to be opened and closed from above.

Further, the door 210 connected to the cover 200 includes a plurality of doors that are arranged in the vertical direction and are individually opened and closed, or includes a plurality of doors that are arranged in the horizontal direction and are individually opened and closed.

In addition, the bowling bag 100 of the present invention further includes an auxiliary bag 400 disposed on the frame 110. The auxiliary bag 400 has a mounting hole 410 formed therein to allow the handle 190 connected to the frame 110 to pass therethrough in the vertical direction.

In this case, the auxiliary bag 400 includes an auxiliary frame 430, which is made of a plastic material and stores one or more bowling balls therein, and a bracket 450, which is coupled to the outer surface of the auxiliary frame 430 and has formed therein the mounting hole 410 through which the handle 190 passes.

In addition, the auxiliary bag 400 further includes an auxiliary cover 470, which is made of a fabric material and is connected to the auxiliary frame 430. The auxiliary cover 470 has a door that is opened and closed from above or doors that are opened and closed from both sides of the auxiliary cover 470.

In this case, the bracket 450 may have a stopper 451 formed in the mounting hole 410 to prevent shaking of the handle 190.

In addition, the auxiliary frame 430 of the auxiliary bag 400 has fixing projections 431 protruding from the lower surface thereof and screw holes 432 formed in the lower surface thereof. When the auxiliary bag 400 is placed on the frame 110, the fixing projections 431 are supported by the grid-shaped ribs 145 formed on the upper surface of the frame 110, and the screw holes 432 are aligned with screw holes in coupling bosses 119 formed on the upper surface of the frame 110. In this state, screws are fastened into the screw holes 432 and the screw holes formed in the coupling bosses 119 of the frame 110, whereby the auxiliary bag 400 is firmly fixed to and supported by the frame 110.

The operational effects of the present invention configured as described above will be described below.

As shown in FIGS. 2 to 27, the frame 110 of the bowling bag 100 of the present invention has a predetermined shape in which one or more storage spaces S are defined. Since the frame 110 is made of a plastic material having predetermined strength, a plurality of bowling balls B or other bowling supplies 900, such as bowling attire or bowling shoes, may be stored in the storage spaces S in the frame 110.

Figure 14:
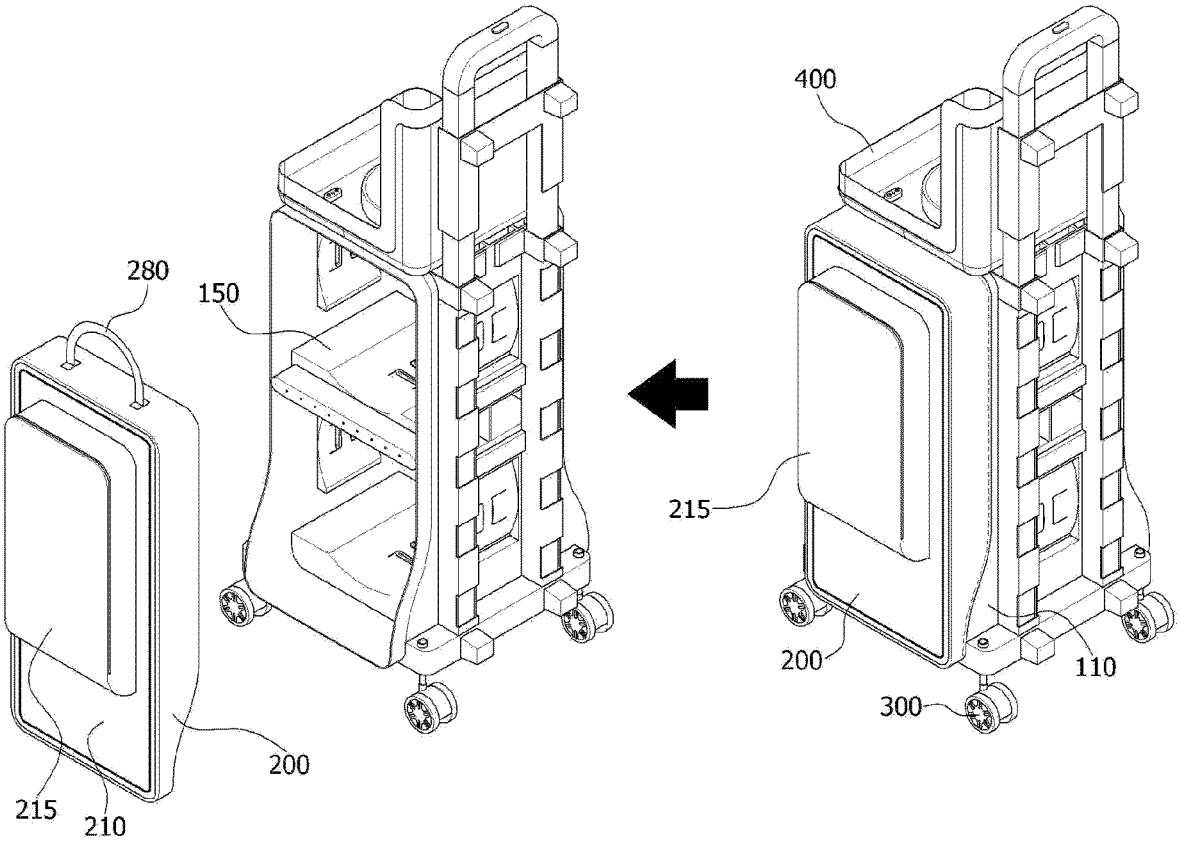
FIGS. 14 to 16 are views showing a use state of side-reception-type bowling bags according to embodiments of the present invention.
Figure 15:
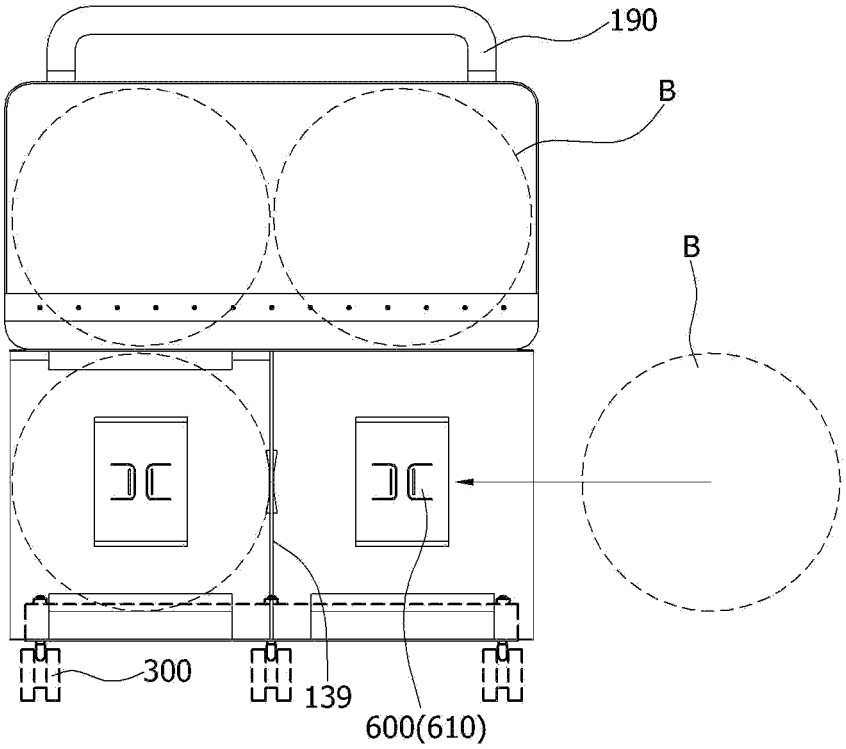
Figure 16:
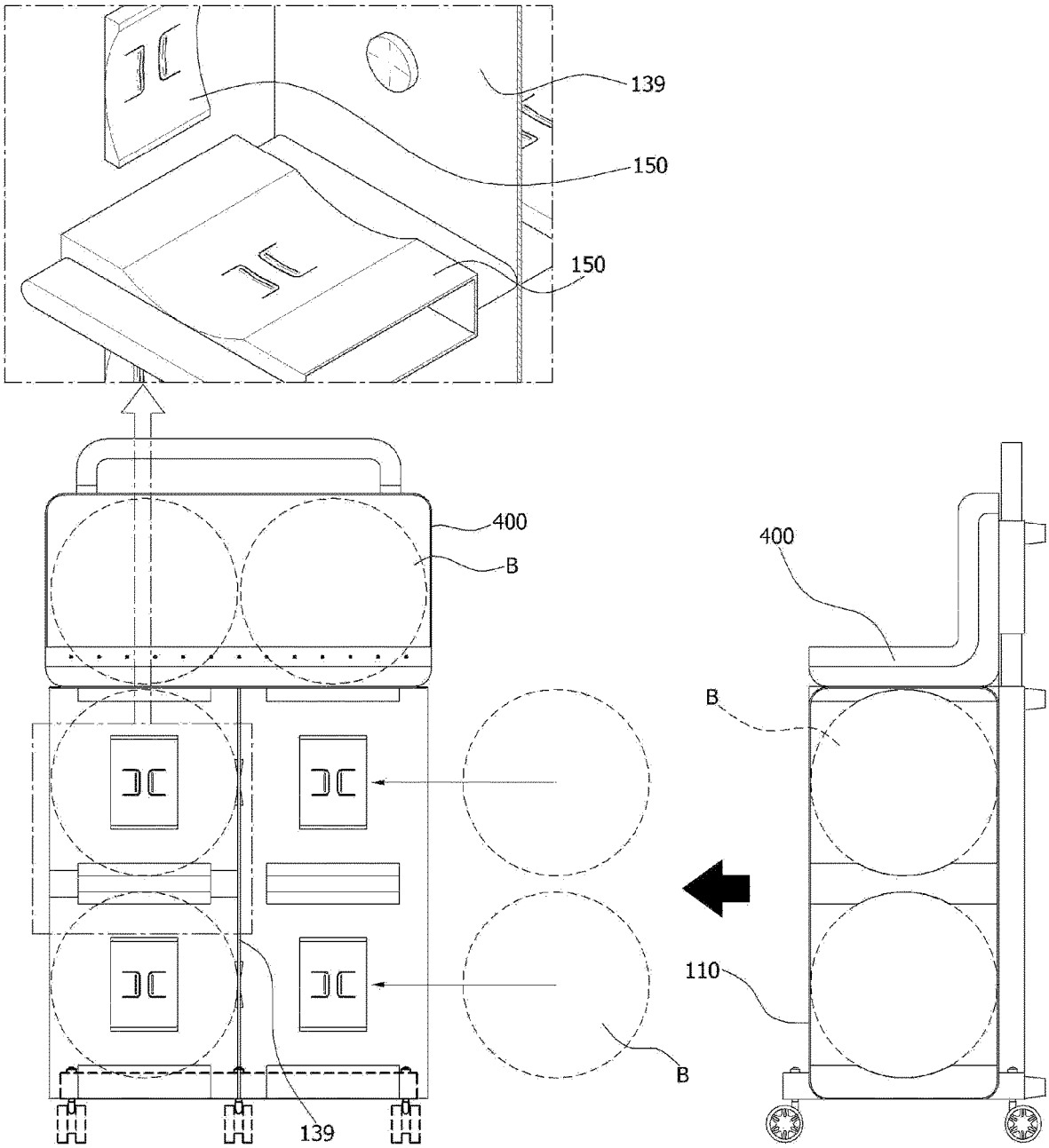

The frame 110 is formed as a unitary body, or is formed in such a manner that constituent elements thereof are individually manufactured and then are assembled with each other. In the case in which the frame 110 is a side-reception-type frame, as shown in FIGS. 14 to 16, the storage space S is partitioned into a plurality of storage spaces by one or more partition plates 139, which are integrally formed with the frame 110 or are separately provided and assembled to the inner side of the frame 110 in the horizontal direction or the vertical direction, and therefore the plurality of bowling balls B is introduced into the plurality of storage spaces from both sides of the frame 110 and is stored therein.

In addition, the frame 110 is formed in a 90°-rotated U shape or an L shape when viewed in a side view such that the ball support 150 coupled to the inner side thereof has predetermined strength, and the cover 200, which is made of a fabric material, is connected to the front side of the frame 110, whereby the overall weight of the bowling bag 100 of the present invention may be reduced.

In addition, the frame 110 has increased strength and reduced weight due to the plurality of ribs 145 integrally formed therewith on the upper surface and the lower surface thereof.

In the case in which the cover 200 is connected to the front side or both sides of the frame 110 to form a hexahedral shape overall together with the frame 110, it is possible to take the bowling balls out of the bowling bag 100 at a position ahead of the bowling bag 100 through the door 210 provided at the cover 200 so as to be oriented in the forward direction or to take the bowling balls out of the bowing bag 100 at positions on both sides of the bowling bag 100 through the doors 210 provided at the cover 200 so as to be oriented in the lateral direction.

The door 210 provided at the cover 200 is oriented toward the front side or at least one of both sides of the frame 110, and is formed to be opened and closed by means of a zipper. Accordingly, it is easy to store and take the bowling balls in and out of the frame 110 through the door 210.

Figure 17:
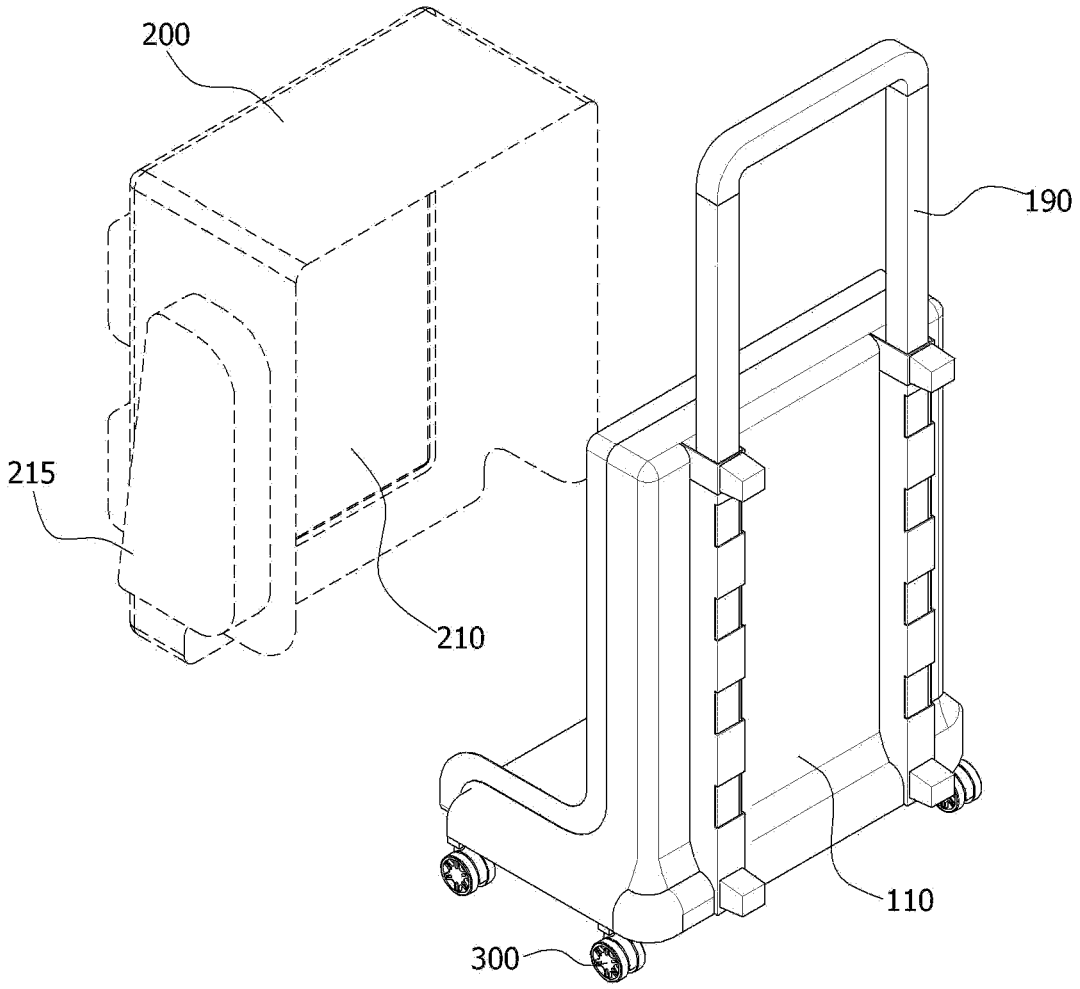
FIGS. 17 to 21 are views showing a use state of front-reception-type bowling bags according to embodiments of the present invention.

As shown in FIGS. 14 and 17, the cover 200 is made of a fabric material, and thus is connected to edges of the front side or both sides of the frame 110 in a sewing manner, a zipper-coupling manner, a rivet-coupling manner, a screw-coupling manner, a button-coupling manner, or the like.

The cover 200 is separately manufactured corresponding to the frame 110, and is connected to the frame 110 to form the overall shape of the bowling bag 100.

Figure 24:
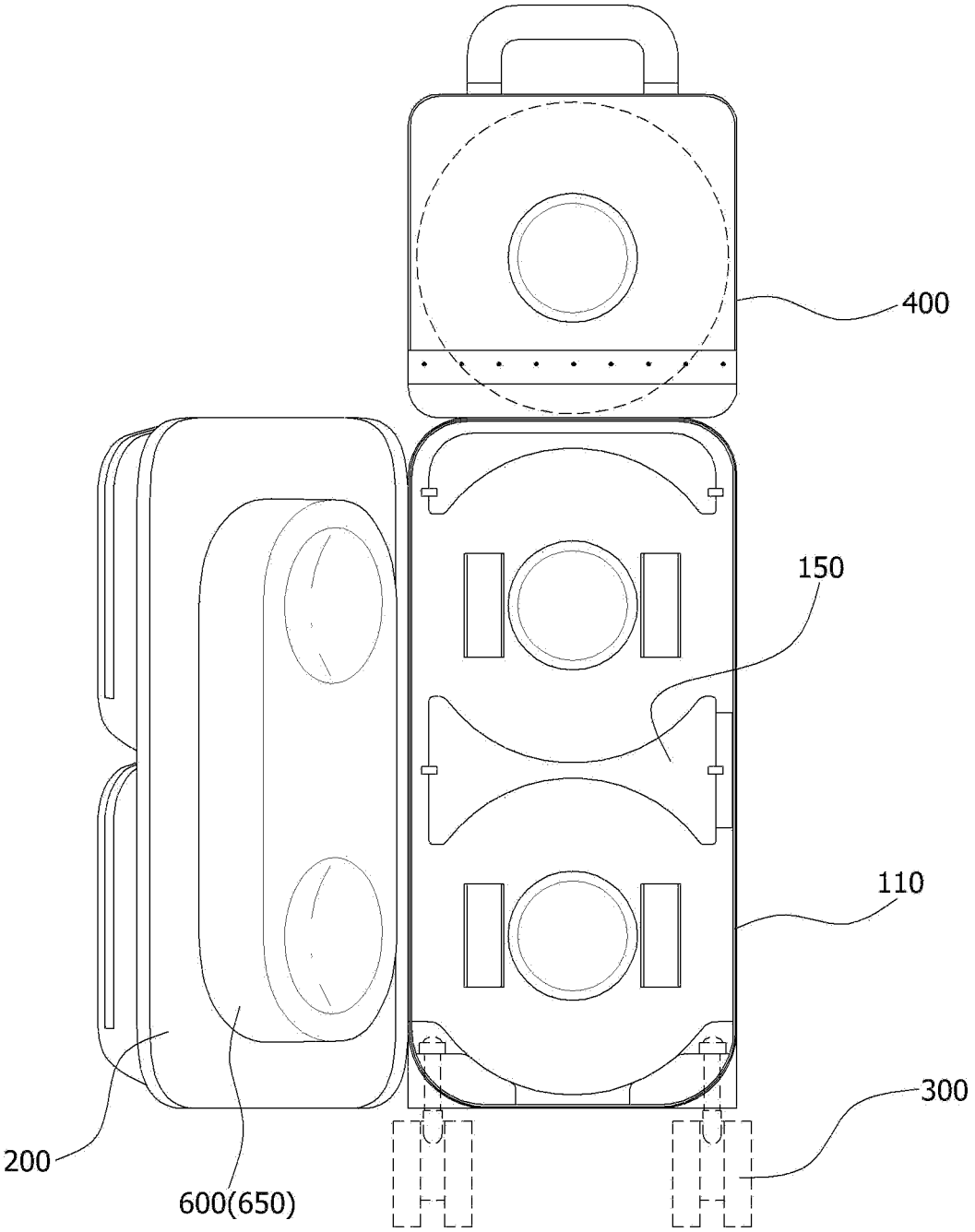

As shown in FIG. 24, the resilient support member 650 integrally formed with the door 210 of the cover 200 has therein a tight contact recess formed corresponding to the shape of the bowling ball. Accordingly, when the door 210 is closed, the tight contact recess in the resilient support member 650 is brought into tight contact with one side of the bowling ball supported by the ball support 150, thereby preventing shaking of the bowling ball and firmly supporting the bowling ball when the bowling bag 100 is moved horizontally.

In addition, as shown in FIG. 14, one or more auxiliary handles 280, which are made of a fabric material, are sewn to the cover 200. Accordingly, when a user pulls the bowling bag 100 using the handle 190 or loads a bowling ball in the bowling bag 100, he or she may additionally use the auxiliary handles 280 to hold the frame 110.

In addition, the door 210 formed at the cover 200 has one or more pockets 215 protruding outwards from the cover 200 and formed to be opened and closed by means of a zipper or the like in order to store various bowling supplies 900.

Figure 9:
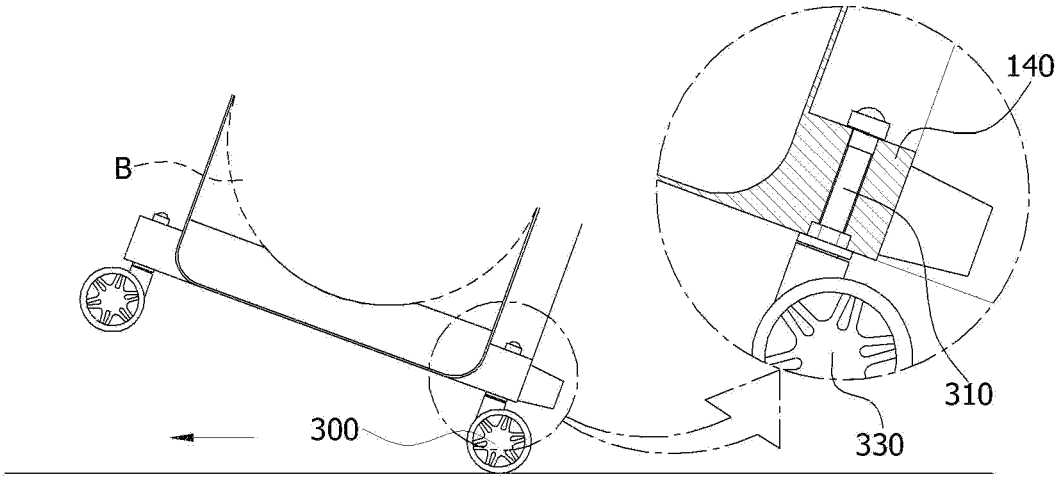
FIG. 9 is a view showing a state in which load is applied to the bowling bag according to the present invention when the bowling bag is in use.

Since the plurality of casters 300 is provided on the lower surface of the frame 110, the bowling bag 100 may be moved horizontally. In detail, the casters 300 enable a user to easily pull the bowling bag 100 using the handle 190 in the state in which the bowling bag 100 is inclined, as shown in FIG. 9, or to easily push the bowling bag 100 in the horizontal direction so that the bowling bag 100 is moved parallel to the ground. That is, the casters 300 reduce force needed to pull or push the bowling bag 100.

Since each of the casters 300 is provided on one side thereof with the brake unit, the bowling bag 100 is prevented from undesirably moving away from a desired location.

Each of casters 300 is connected to the frame 110 through the support hole 160 formed in one side of the frame 110, and is secured to the frame 110 by means of the coupling member 350. The coupling member 350 enables firm coupling and easy separation of each of the casters 300 to and from the frame 110, thereby facilitating repair and maintenance of the casters 300.

In addition, since one or more ball supports 150 are provided in the frame 110 to support one or more bowling balls B in the horizontal direction or the vertical direction, it is possible to prevent shaking of the bowling balls B when the bowling bag 100 is moved horizontally in the state in which the bowling balls B are loaded therein.

Figure 22:
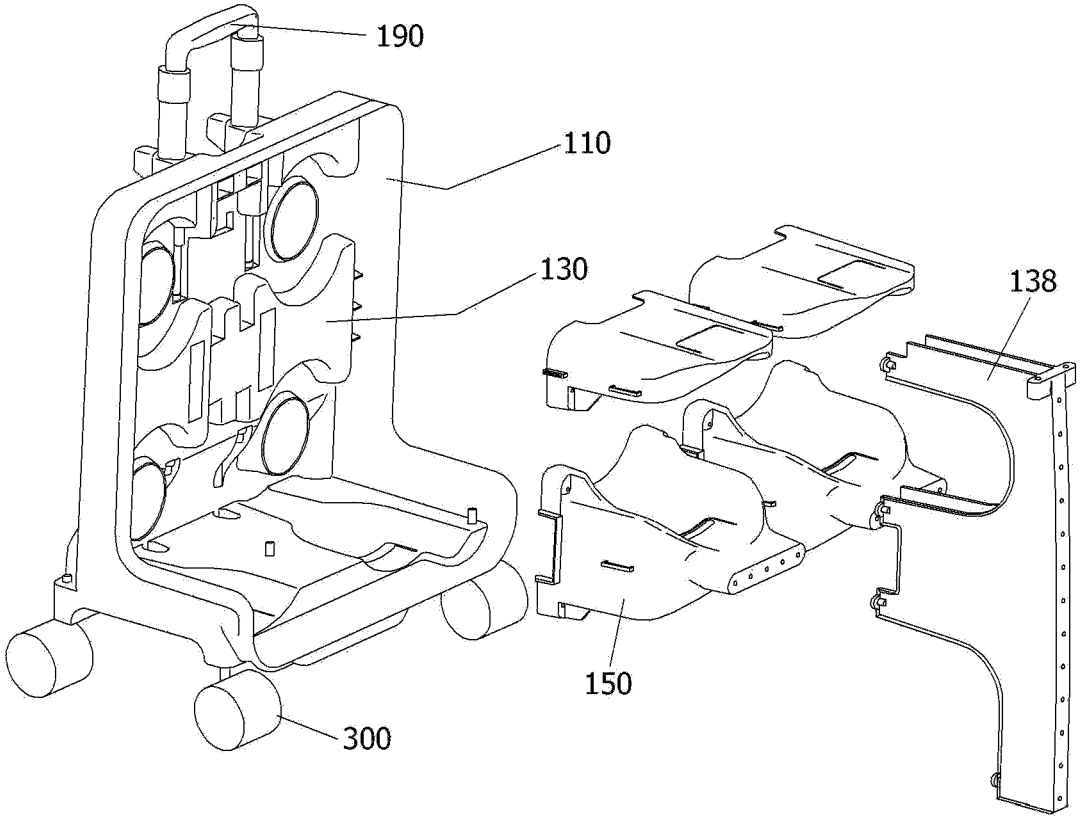
FIG. 22 is a view showing a mounting state of a ball support in the bowling bag according to the present invention.

The ball support 150 may be assembled to the fixing block 130, which is formed so as to protrude from the inner side of the frame 110, in an interference-fit manner or a screw-coupling manner, as shown in FIG. 22, or may be formed on the inner side surface of the frame 110.

In the case in which the ball support 150 is formed on the inner side surface of the frame 110, the ball support 150 is integrally formed with the frame 110.

In addition, the shaking prevention member 600 integrally formed with the ball support 150 functions to prevent shaking of the bowling ball disposed on the upper surface or one side of the ball support 150 when the frame 110 is moved horizontally.

Figure 2:
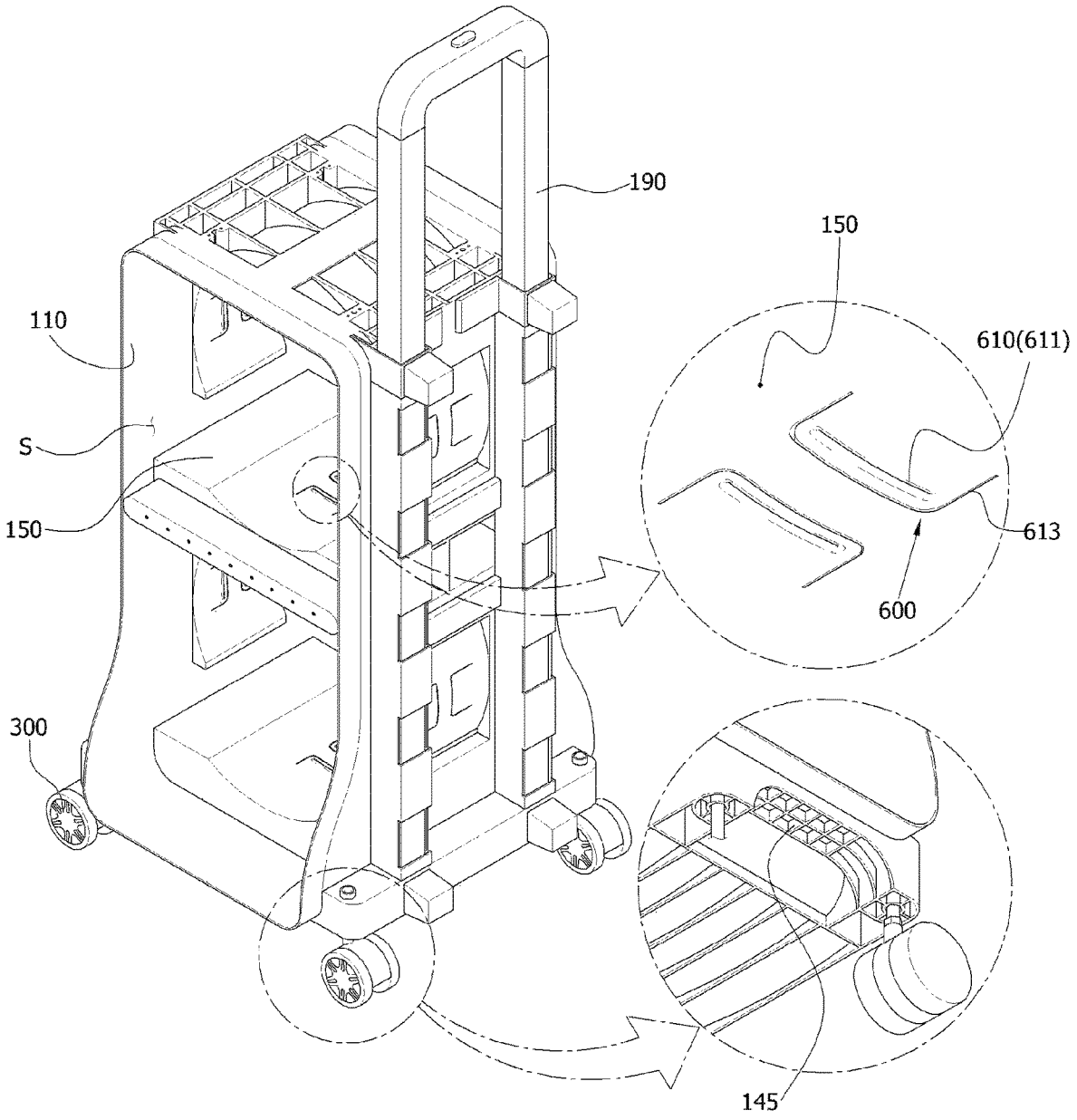
FIG. 2 is a perspective view showing a side-opening-type bowling bag according to the present invention.

As one embodiment of the shaking prevention member 600, as shown in FIG. 2, the tension portion 610 is formed by cutting a portion of the ball support 150 along the incision line 613 so as to be resiliently bendable relative to the portion of the ball support 150. Further, the tension portion 610 has the protrusion 611 formed on the upper surface thereof. Accordingly, it is possible to easily load the bowling ball on the ball support 150 and to reliably support the bowling ball.

In this case, the protrusion 611 is integrally formed with the ball support 150, is attached thereto, or is assembled therewith in a fitting manner.

Figure 23:
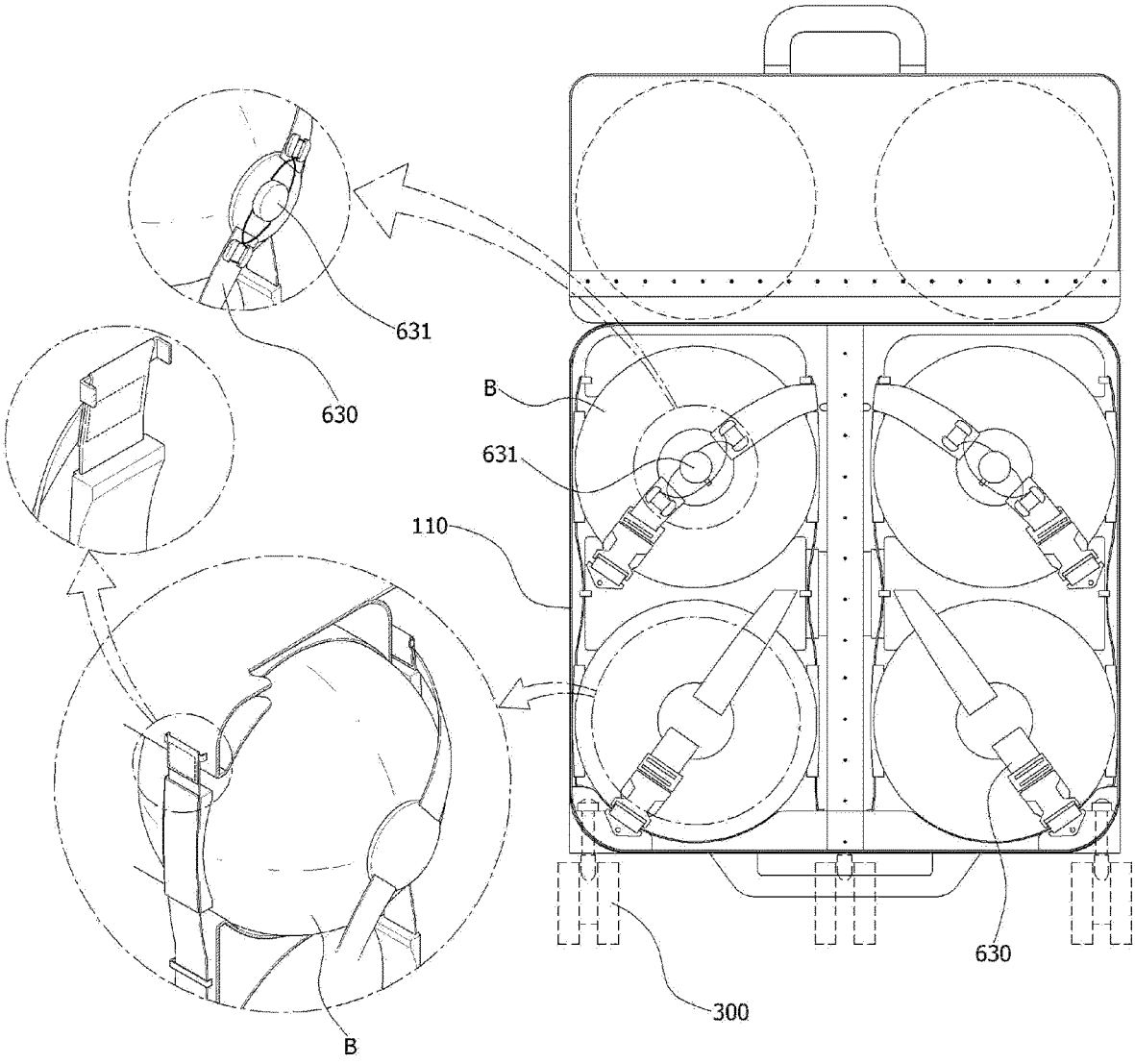
FIGS. 23 and 24 are views showing a mounting state of shaking prevention members for supporting a bowling ball according to embodiments of the present invention.

As another embodiment of the shaking prevention member 600, as shown in FIG. 23, the safety-belt-type support belt 630 is mounted to the front side of the ball support 150. The support belt 630 is formed to be fastened and released and has the tension adjustment knob 631 for adjusting the tension thereof, thereby preventing the bowling ball from escaping from the ball support 150 in the forward direction. Accordingly, it is possible to reliably support the bowling ball, thus preventing overturn or non-smooth movement of the bowling bag 100 due to shaking of the bowling ball during horizontal movement of the bowling bag 100.

As still another embodiment of the shaking prevention member 600, as shown in FIG. 24, the resilient support member 650, which is made of a sponge material, is provided so as to protrude from the inner side of the cover 200. The resilient support member 650 functions to support the bowling ball more reliably together with at least one of the above-described embodiments of the shaking prevention member. Alternatively, the resilient support member 650 alone supports the bowling ball loaded on the ball support 150. Accordingly, it is possible to prevent shaking of the bowling ball during horizontal movement of the bowling bag 100.

Figure 26:
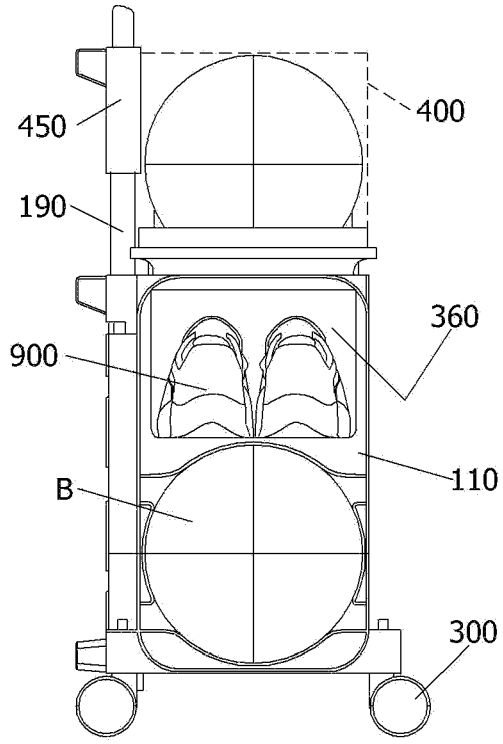
FIGS. 26 and 27 are views showing a use state of the bowling bag when storage chambers according to embodiments of the present invention are applied thereto.

In addition, as shown in FIG. 26, the storage chamber 360 for storing bowling supplies such as bowling shoes is provided in one side of the frame 110 so as to be isolated from the space for loading the bowling ball therein, thereby making it possible to store bowling shoes as well as the bowling ball in the frame 110.

Figure 27:
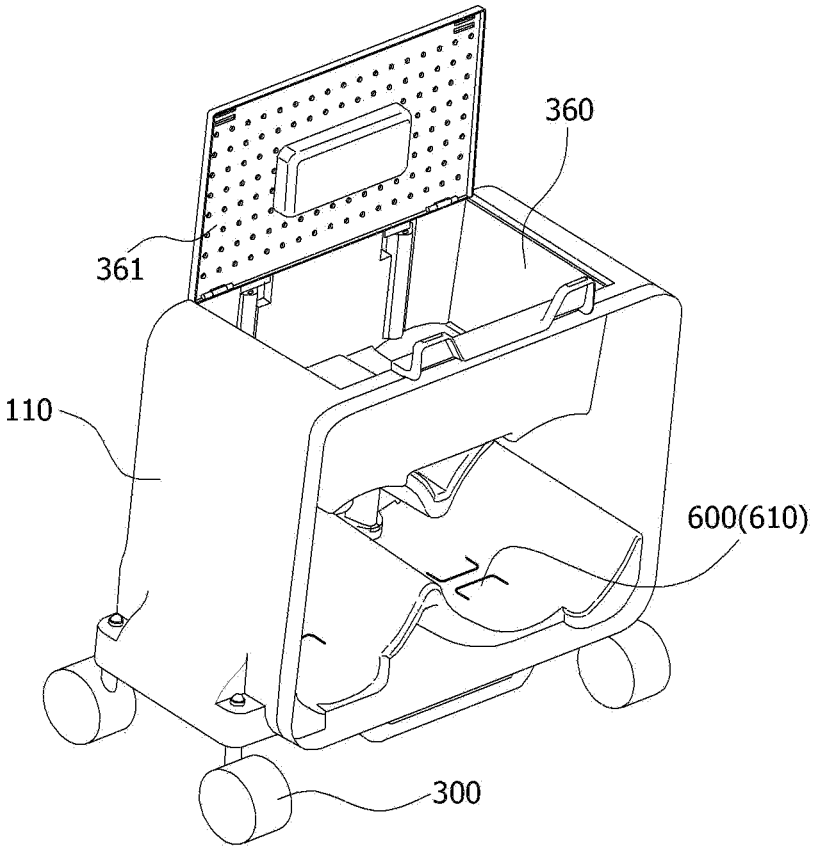

As shown in FIG. 27, a portion of the upper surface of the frame 110 is open so as to communicate with the storage chamber 360, and the chamber door 361 is connected to the upper surface of the frame 110 to open and close the storage chamber 360. The chamber door 361 is of a one-touch opening and closing operation type, and is coupled to the frame 110 so as to be opened and closed from above. Accordingly, it is possible to easily store and take bowling shoes in and out of the storage chamber 360 without the necessity to open the door 210.

Further, the door 210 connected to the cover 200 includes a plurality of doors that are arranged in the vertical direction and are individually opened and closed, or includes a plurality of doors that are arranged in the horizontal direction and are individually opened and closed. Accordingly, it is possible to selectively open and close the door corresponding to a desired storage space.

In addition, as shown in FIG. 22, the reinforcing plate 138 is provided on the inner side of the frame 110 in order to firmly support the cover 200 in the horizontal direction and the vertical direction. In the case in which the cover 200 having the doors 210 coupled to the upper and lower portions and both sides thereof is connected to the frame 110, the reinforcing plate 138 prevents separation or deformation of the cover 200 when the doors 210 are opened and closed.

As shown in FIG. 14, the frame 110 and the cover 200 may constitute the bowling bag 100 capable of loading a plurality of bowling balls therein in the lateral direction thereof. In this case, the bowling bag 100 may have a configuration selected from among:

- a configuration in which a maximum of four bowling balls is loaded in such a manner that two bowling balls are loaded in the horizontal direction in the frame 110 and two bowling balls are loaded in the horizontal direction in the auxiliary bag 400 disposed on the frame 110, as shown in FIG. 15; and
- a configuration in which a maximum of six bowling balls is loaded in such a manner that four bowling balls are loaded in the horizontal and vertical directions in the frame 110 and two bowling balls are loaded in the horizontal direction in the auxiliary bag 400 disposed on the frame 110, as shown in FIG. 16.

Figure 18:
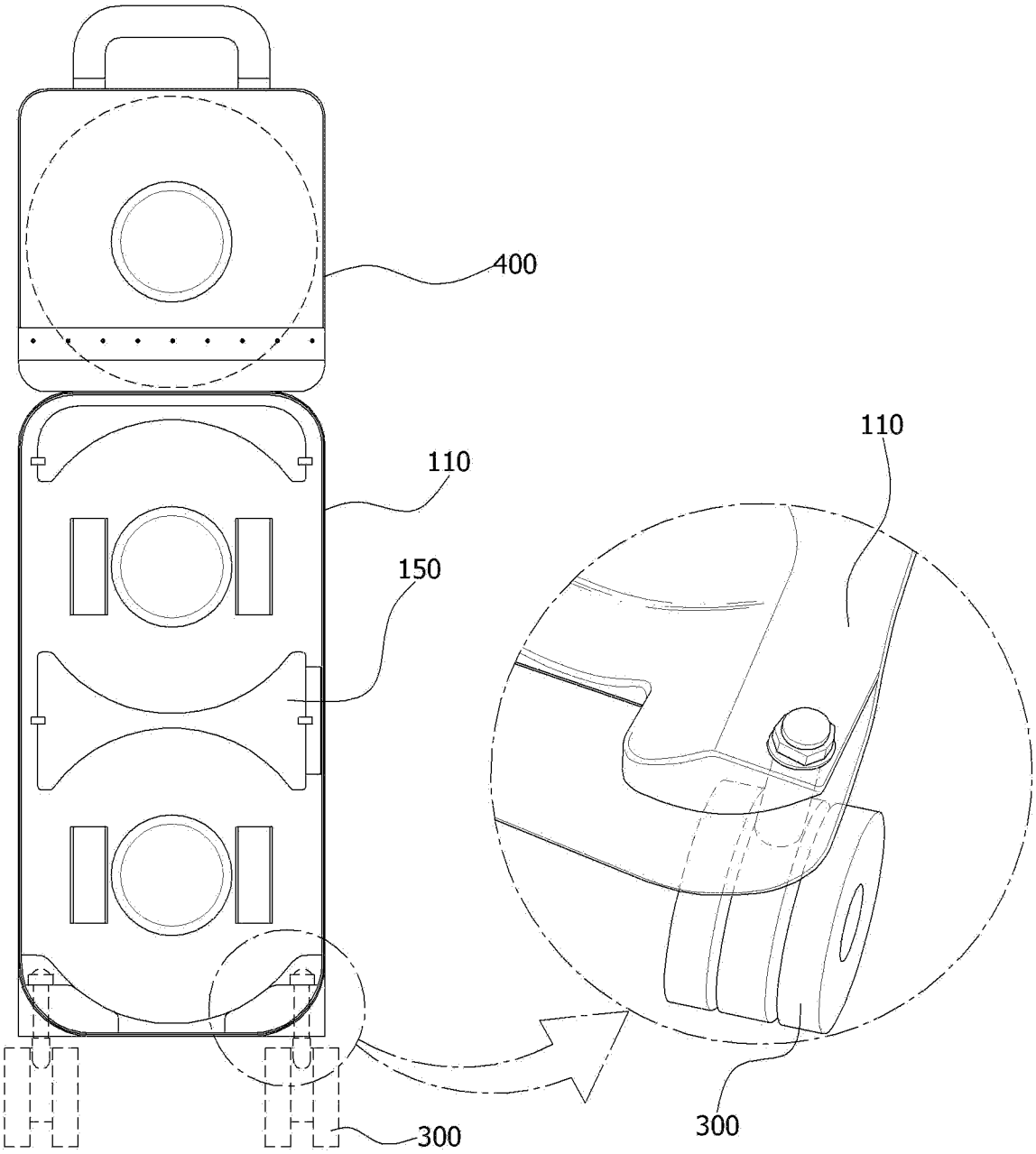
Figure 19:
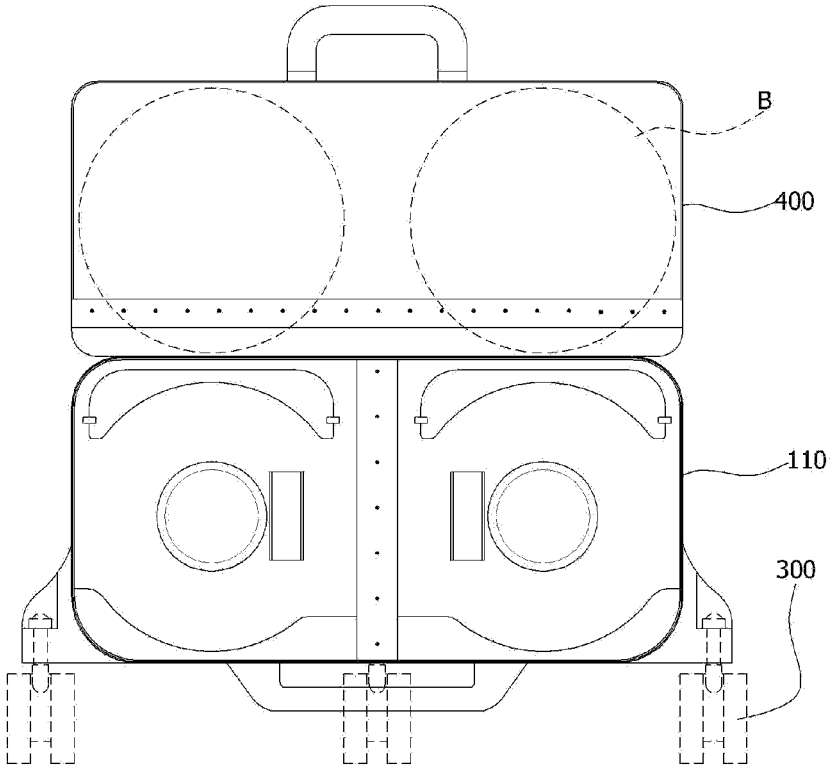
Figure 20:
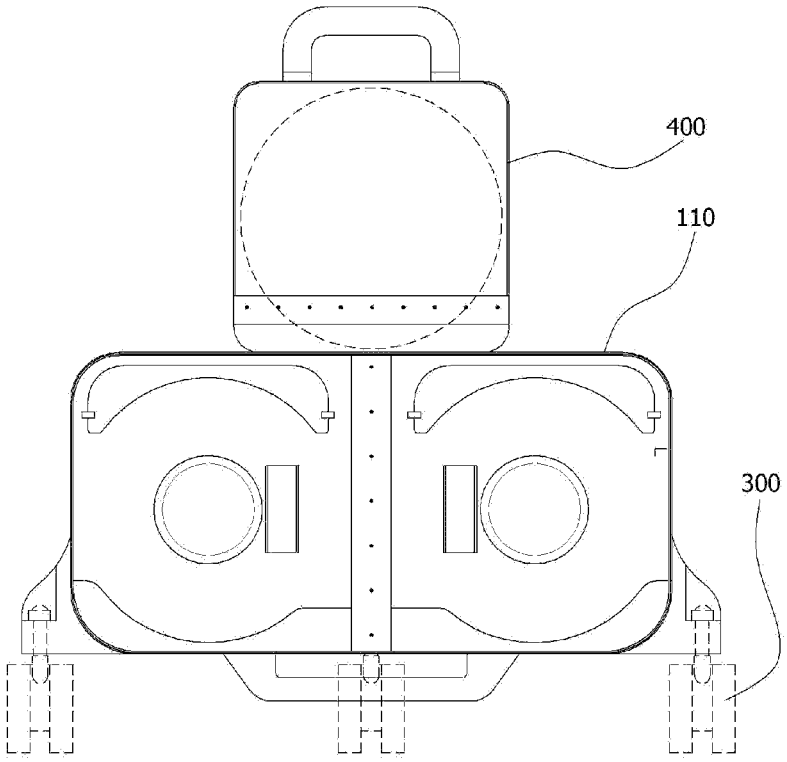
Figure 21:
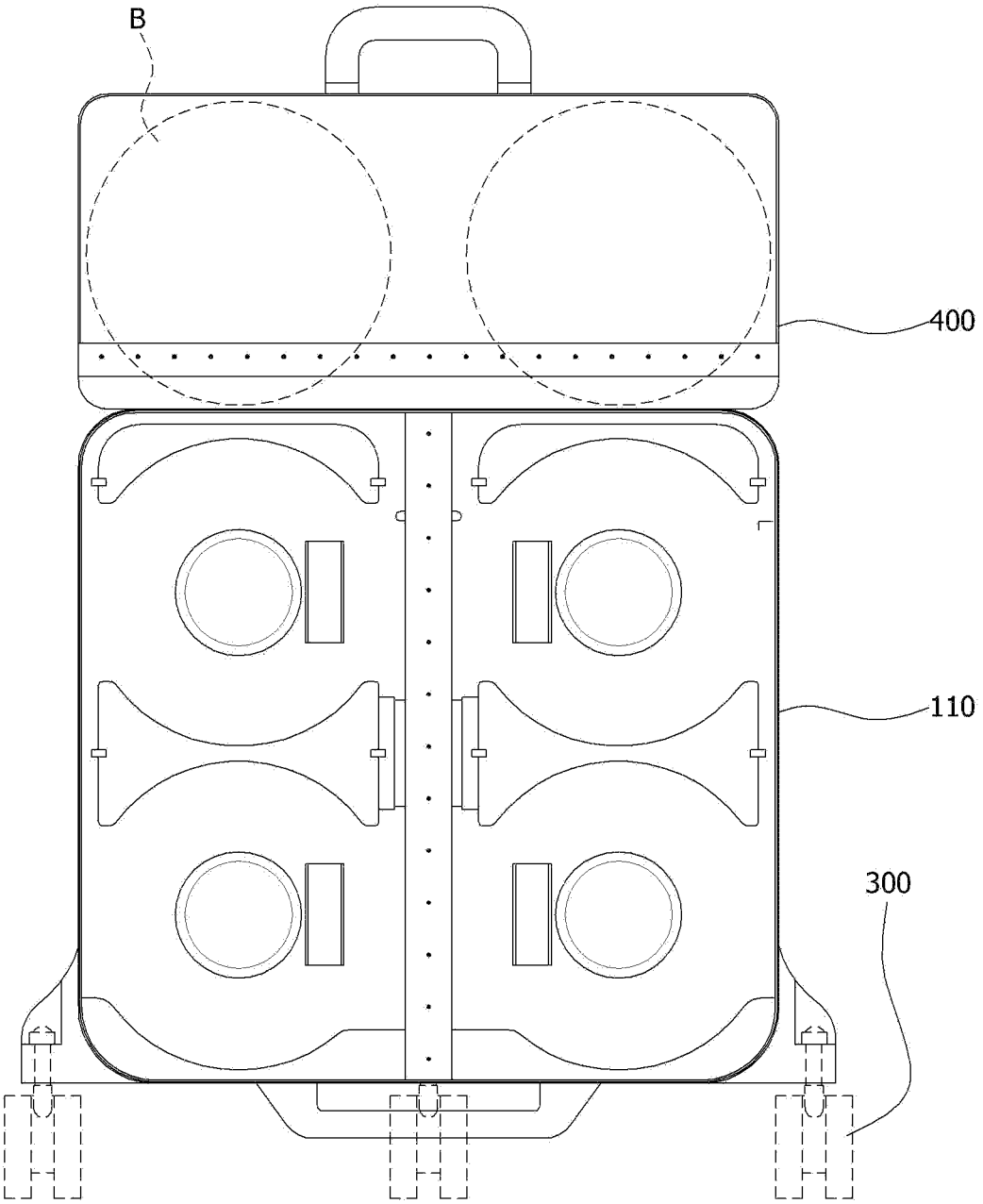
Figure 25:
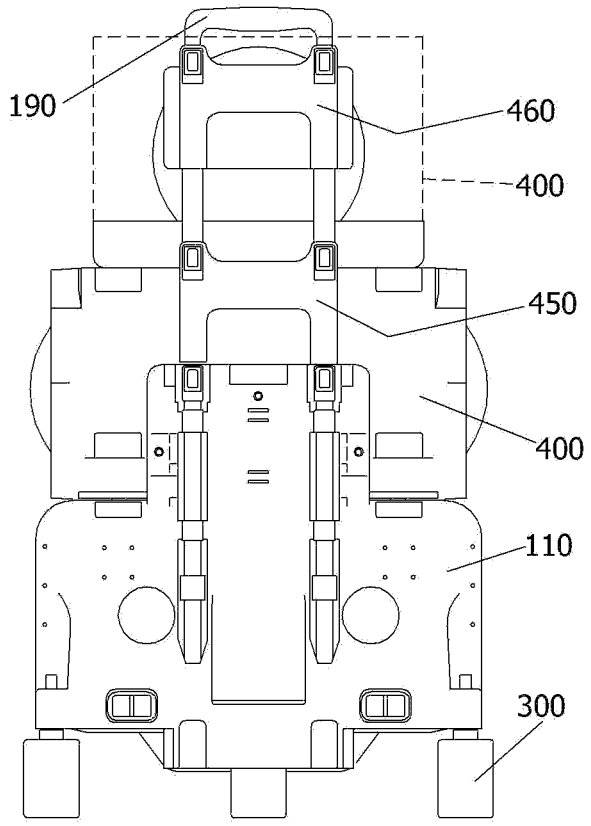
FIG. 25 is a view showing a state in which auxiliary bags are stacked on the bowling bag according to the present invention.

Alternatively, as shown in FIG. 17, the frame 110 and the cover 200 may constitute the bowling bag 100 enabling a user to load a plurality of bowling balls therein at a position ahead of the bowling bag 100. In this case, the bowling bag 100 may have a configuration selected from among:

- a configuration in which a maximum of three bowling balls is loaded in such a manner that two bowling balls are loaded in the vertical direction in the frame 110 and one bowling ball is loaded in the auxiliary bag 400 disposed on the frame 110, as shown in FIG. 18;
- a configuration in which a maximum of four bowling balls is loaded in such a manner that two bowling balls are loaded in the horizontal direction in the frame 110 and two bowling balls are loaded in the horizontal direction in the auxiliary bag 400 disposed on the frame 110, as shown in FIG. 19;
- a configuration in which a maximum of three bowling balls is loaded in such a manner that two bowling balls are loaded in the horizontal direction in the frame 110 and one bowling ball is loaded in the auxiliary bag 400 disposed on the frame 110, as shown in FIG. 20;
- a configuration in which a maximum of six bowling balls is loaded in such a manner that four bowling balls are loaded in the horizontal and vertical directions in the frame 110 and two bowling balls are loaded in the horizontal direction in the auxiliary bag 400 disposed on the frame 110, as shown in FIG. 21; and
- a configuration in which a maximum of five bowling balls is loaded in such a manner that two bowling balls are loaded in the horizontal direction in the frame 110, two bowling balls are loaded in the horizontal direction in the auxiliary bag 400 disposed on the frame 110, and one bowling ball is loaded in another auxiliary bag disposed on the auxiliary bag 400, as shown in FIG. 25.

Figure 12:
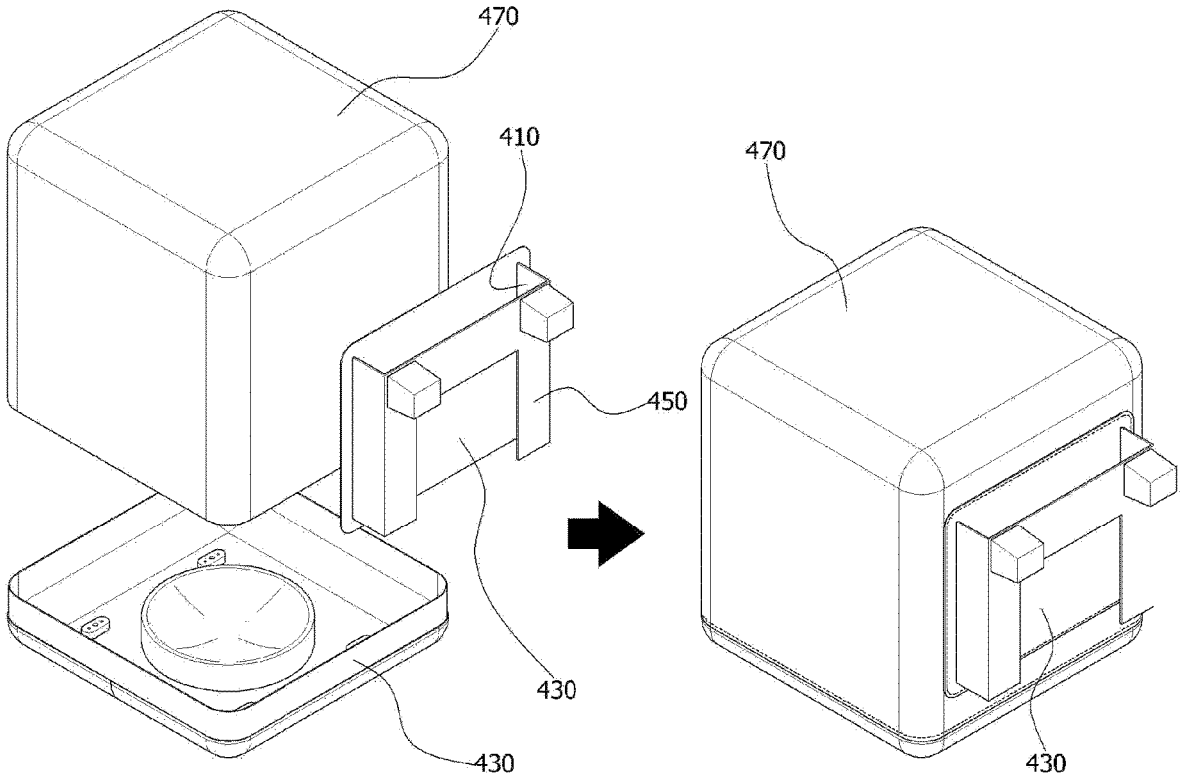
FIGS. 12 and 13 are views showing auxiliary bags according to embodiments of the present invention.
Figure 13:
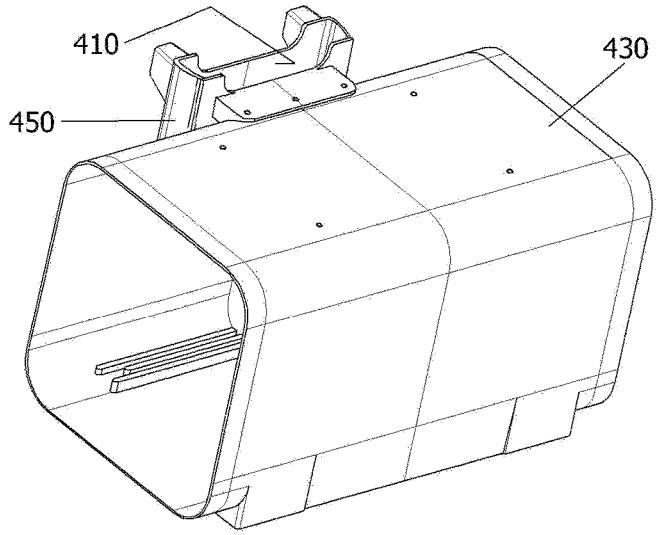

Referring to FIG. 25, the auxiliary bag 400 having doors that are opened and closed from both sides thereof and the auxiliary bag having a door that is opened and closed from above are sequentially stacked on the frame 110. In the case of the auxiliary bag having a door that is opened and closed from above, as shown in FIG. 12, the auxiliary cover 470, which is made of a fabric material, is connected to the upper side of the auxiliary frame 430. In the case of the auxiliary bag 400 having the doors that are opened and closed from both sides thereof, as shown in FIG. 13, the auxiliary covers 470, which are made of a fabric material, are connected to both sides of the auxiliary frame 430.

Figure 10:
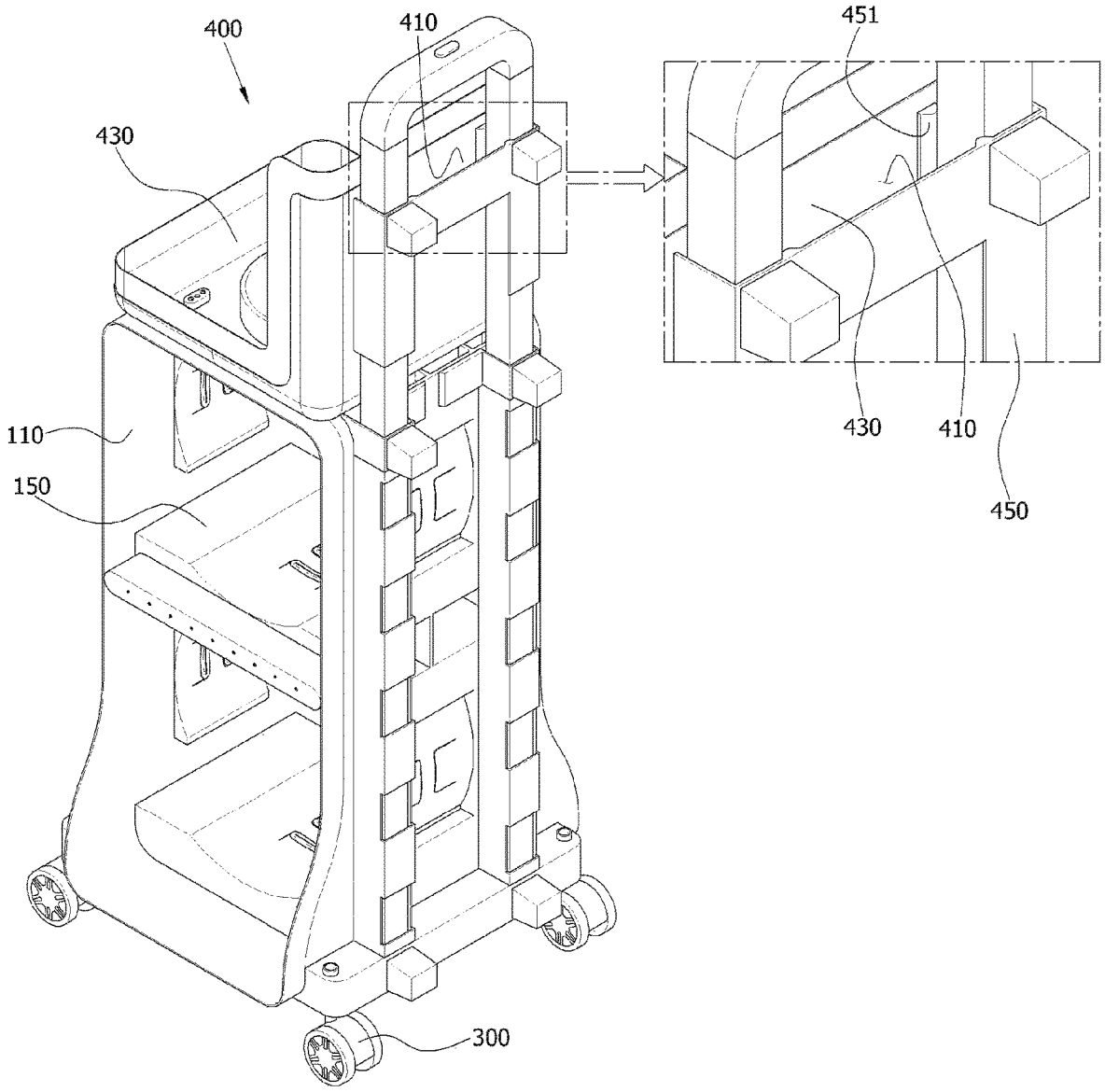
FIGS. 10 and 11 are, respectively, a view showing a use state of the bowling bag when an auxiliary bag according to an embodiment of the present invention is applied thereto and a view showing a state of separation of the auxiliary bag from the bowling bag.

When the auxiliary bag 400 is stacked on the frame 110, the handle 190 passes through the mounting hole 410 formed in the bracket 450. As shown in FIG. 10, the stopper 451 formed in the mounting hole 410 prevents shaking of the handle 190.

Figure 11:
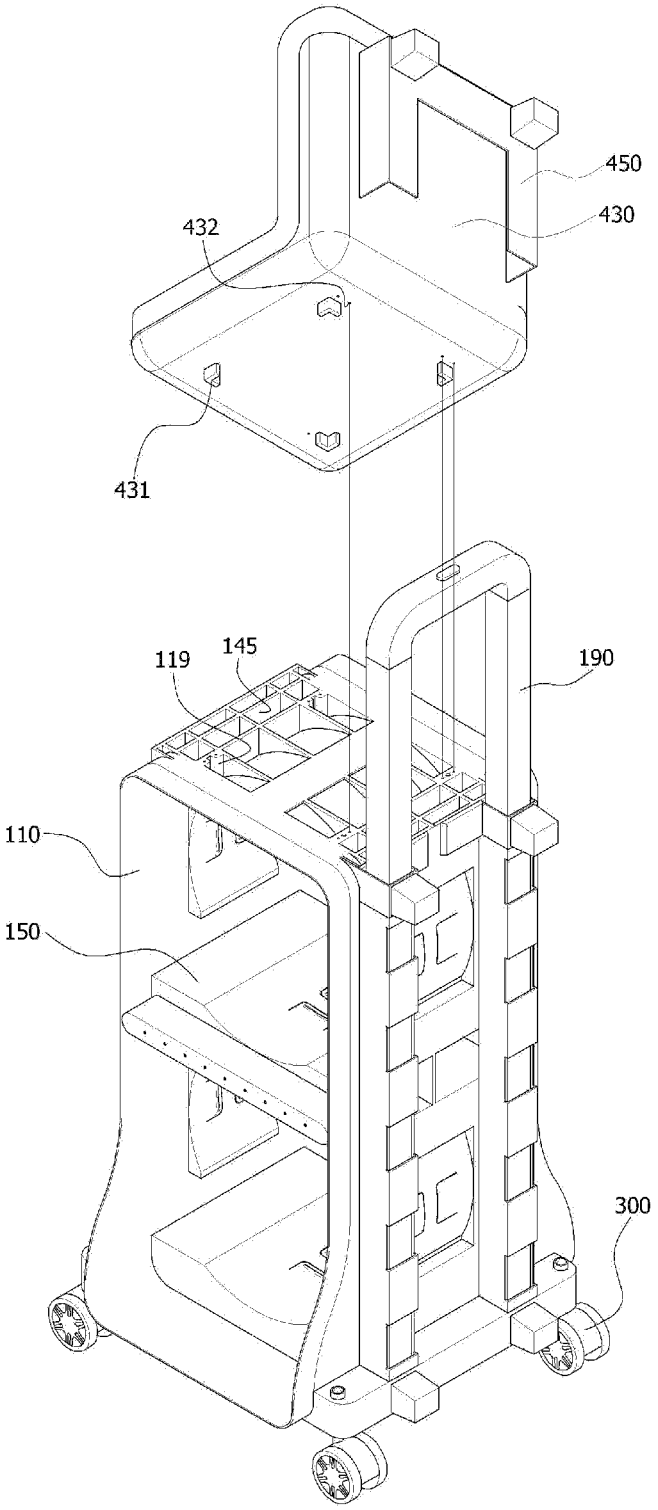

As shown in FIG. 11, the auxiliary bag 400 has the fixing projections 431 protruding from the lower surface of the auxiliary frame 430 and the screw holes 432 formed in the lower surface of the auxiliary frame 430. When the auxiliary bag 400 is placed on the frame 110, the fixing projections 431 are supported by the grid-shaped ribs 145 formed on the upper surface of the frame 110, and the screw holes 432 are aligned with the screw holes in the coupling bosses 119 formed on the upper surface of the frame 110. In this state, screws are fastened into the screw holes 432 and the screw holes formed in the coupling bosses 119 of the frame 110, whereby the auxiliary bag 400 is firmly fixed to and supported by the frame 110, and therefore the bowling bag 100 and the auxiliary bag 400 stacked thereon are stably moved together.

In this case, the auxiliary bag 400 stores one or more bowling balls in a manner of loading the same on the auxiliary frame 430, which is made of a plastic material. When the auxiliary bag 400 is placed on the frame 110, the handle 190 passes through the mounting hole 410 formed in the bracket 450, which is coupled to the outer surface of the auxiliary frame 430. Due to assembly of the handle 190 and the bracket 450, the auxiliary bag 400 is firmly supported by the bowling bag 100.

Since the auxiliary cover 470, which is made of a fabric material and has a door that is opened and closed from above or doors that are opened and closed from both sides thereof, is connected to the auxiliary frame 430, it is possible to manufacture auxiliary bags having different shapes, as shown in FIGS. 12 and 13.

In addition, as shown in FIGS. 3 to 9, each of the casters 300 mounted to the frame 110 includes the fixing boss 310, which is supported by the frame 110 by means of the coupling member 350, and the drive wheel 330, which is connected to the lower end of the fixing boss 310 so as to be freely rotatable. Accordingly, the bowling bag 100 may be easily moved and changed in direction.

When the fixing boss 310 is inserted into the support hole 160 formed in the frame 110, the coupling member 350, which is removably coupled to the upper end portion of the fixing boss 310, is exposed to the outside of the frame 110. Accordingly, it is possible to rapidly replace the caster 300 in the event of damage thereto.

Figure 4:
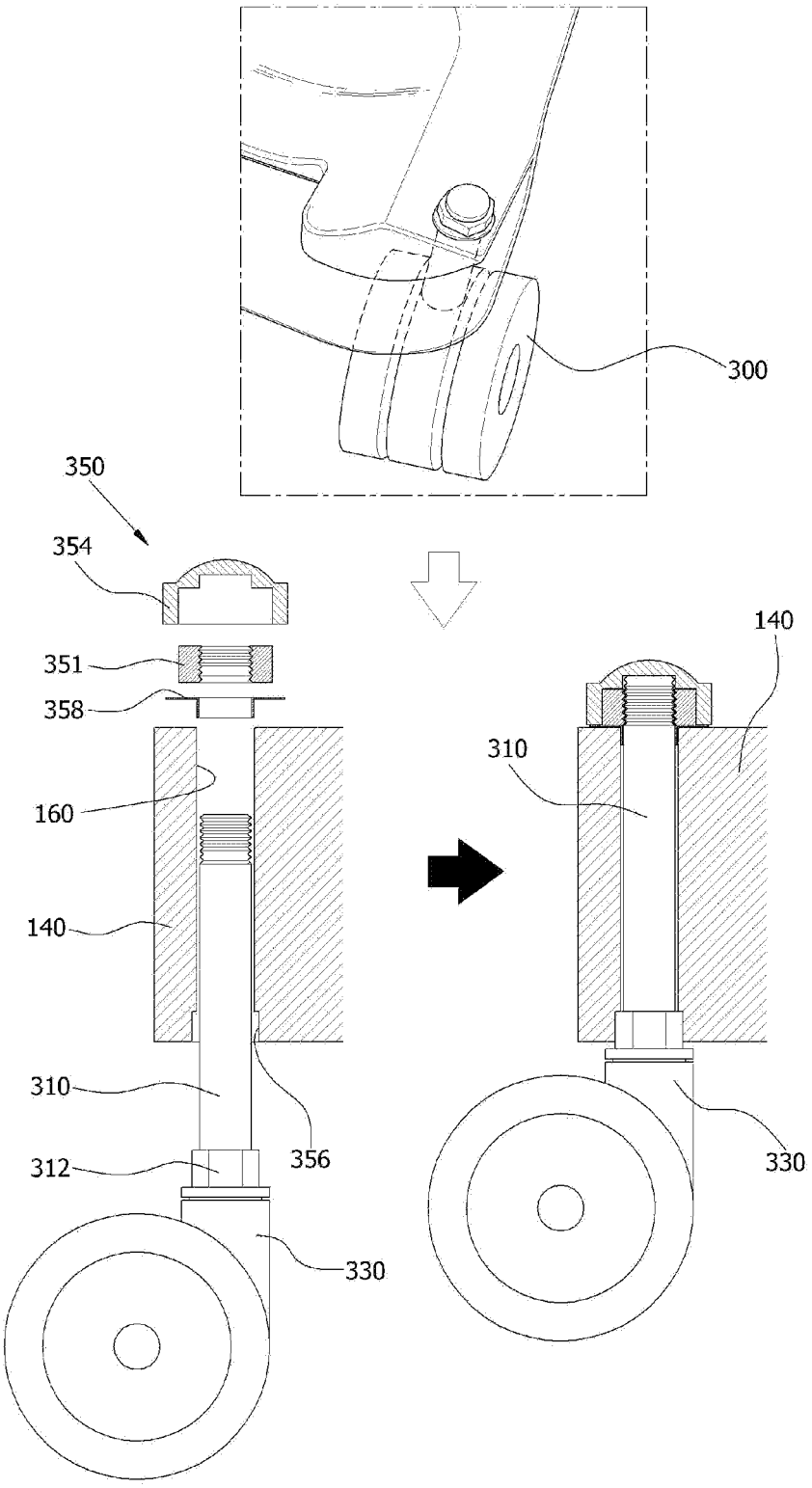
Figure 6:
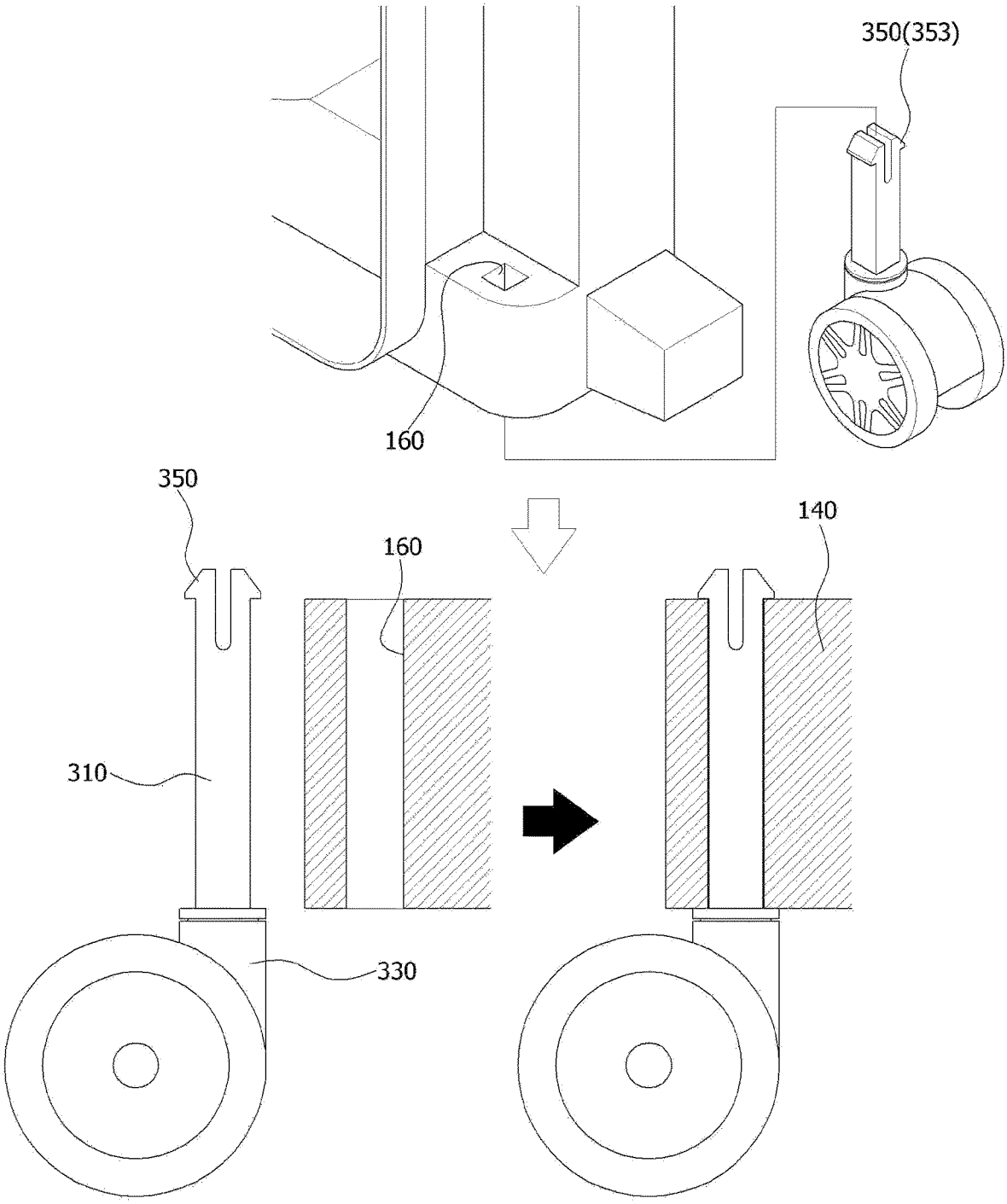
Figure 8:
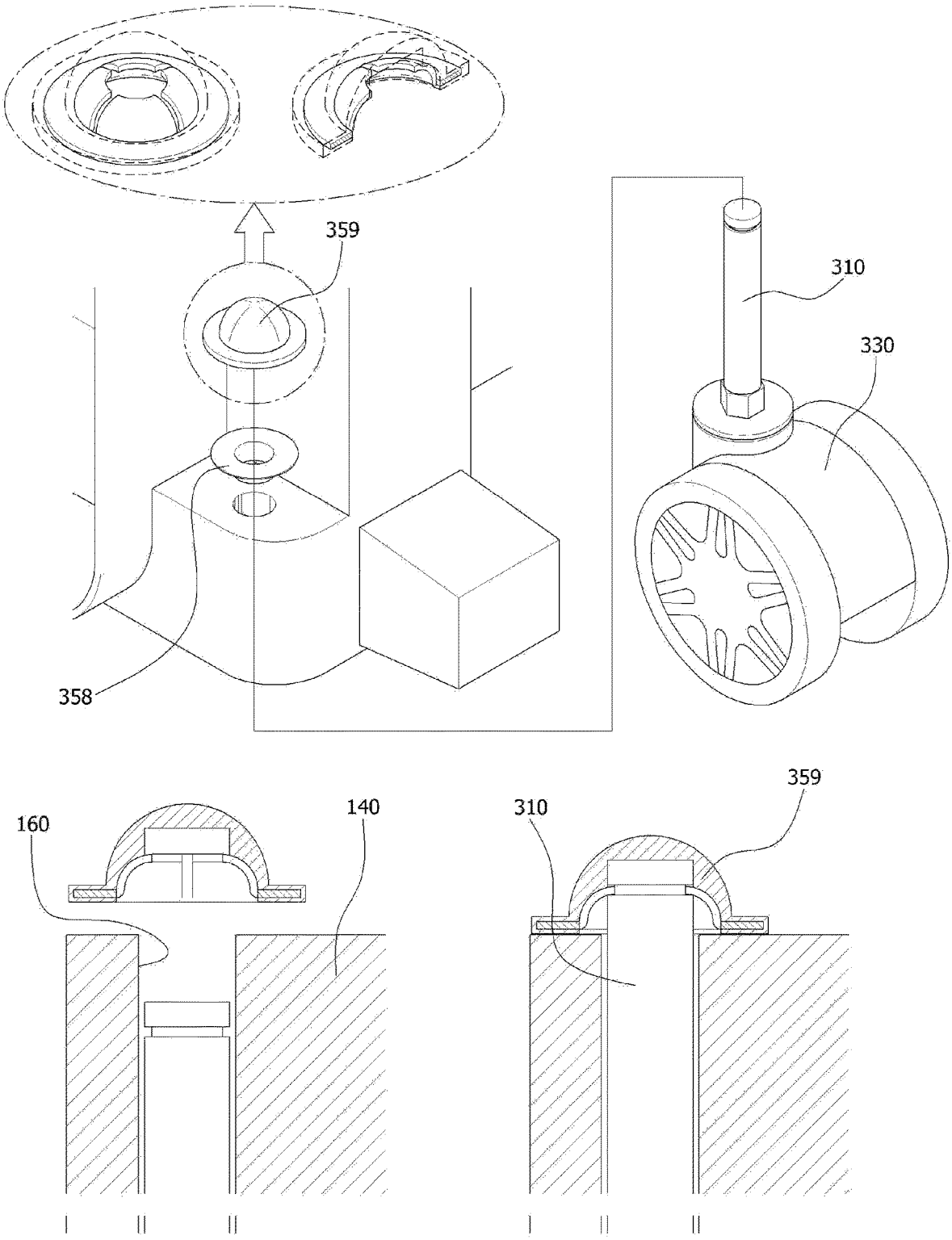

In this case, as shown in FIGS. 4, 6, and 8, the support hole 160 is formed in the support section 140 having a predetermined height and a predetermined width. The support section 140 functions to disperse load applied to the fixing boss 310 in the vertical direction and the horizontal direction, thereby preventing damage to the frame 110.

In addition, the support section 140 is formed by protruding one side of the lower portion of the frame 110 outwards, or is formed on the outer corner of the lower portion of the frame 110, whereby the frame 110 has a sufficient amount of strength without change in the shape thereof.

Figure 3:
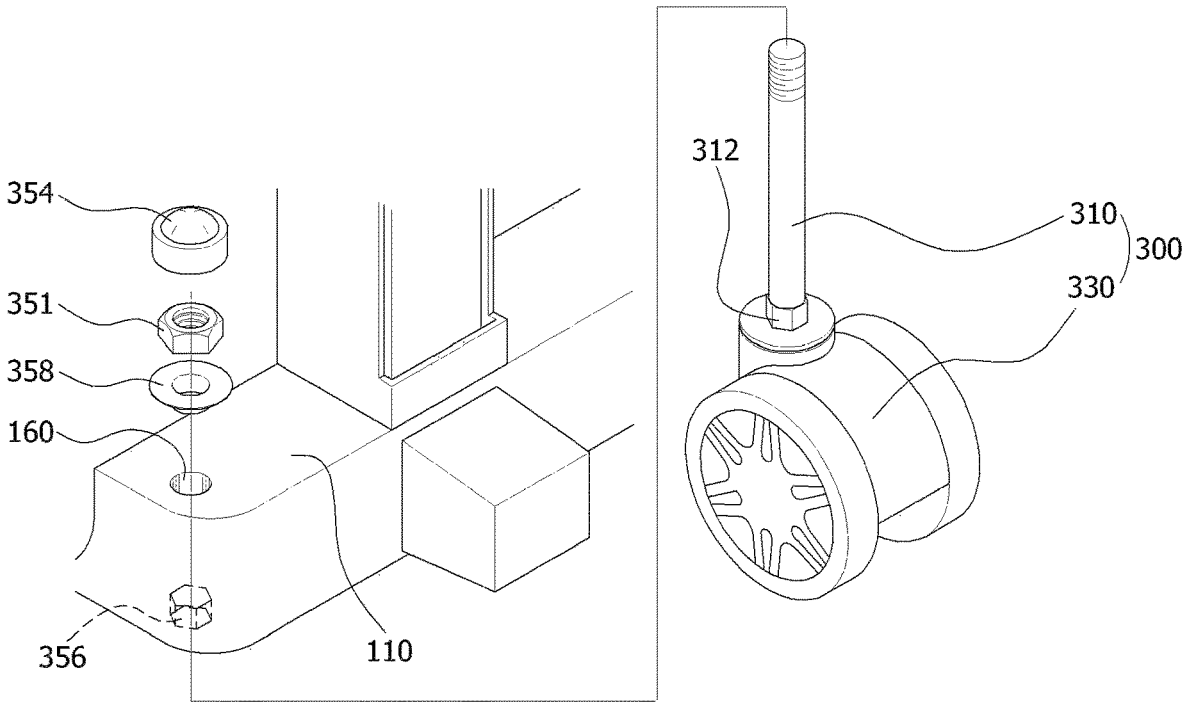
FIGS. 3 and 4 are, respectively, an exploded view of a caster according to the present invention and a view showing an assembled state of the caster.

As shown in FIGS. 3 and 4, the coupling member 350 is configured such that a thread is formed on the fixing boss 310 and the nut 351 is engaged with the thread to fix the fixing boss 310 in the support hole 160. Accordingly, it is possible to easily separate the fixing boss 310 from the support hole 160 merely by releasing the nut 351 from the thread.

Figure 5:
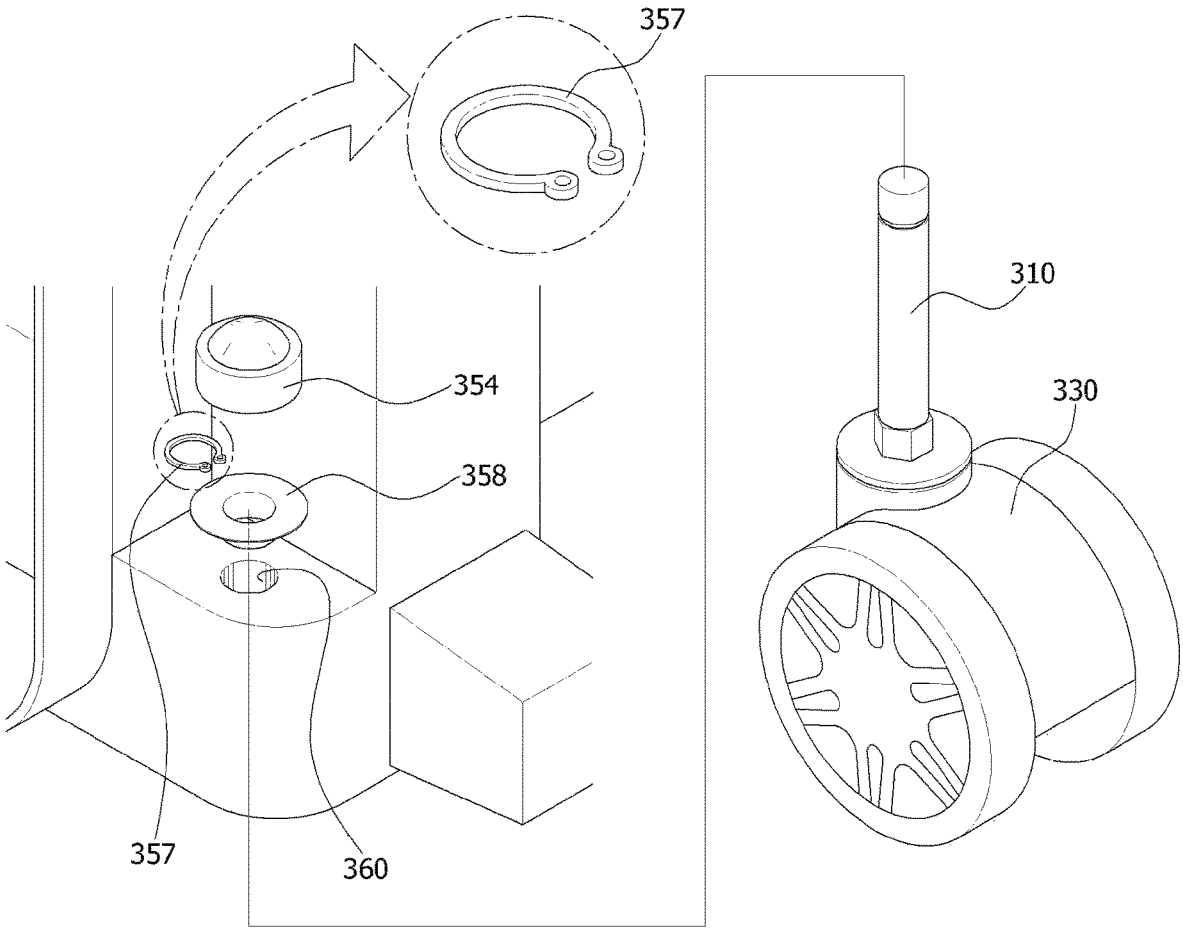
FIGS. 5 to 8 are views showing an assembled state of casters according to other embodiments of the present invention.

As shown in FIG. 5, the coupling member 350 is configured such that a ring hole is formed in the peripheral surface of the fixing boss 310 and the fixing ring 357 is inserted into the ring hole to fix the fixing boss 310 in the support hole 160. Accordingly, it is possible to easily separate the fixing boss 310 from the support hole 160 merely by separating the fixing ring 357 from the ring hole.

As shown in FIG. 6, the coupling member 350 is configured such that the elastic hook 353 is formed on the upper end of the fixing boss 310 so as to be pressed by the support hole 160 and to be caught by the upper surface of the support section 140 when escaping from the support hole 160. Accordingly, it is possible to easily separate the fixing boss 310 from the support hole 160 merely by pressing the elastic hook 353.

Figure 7:
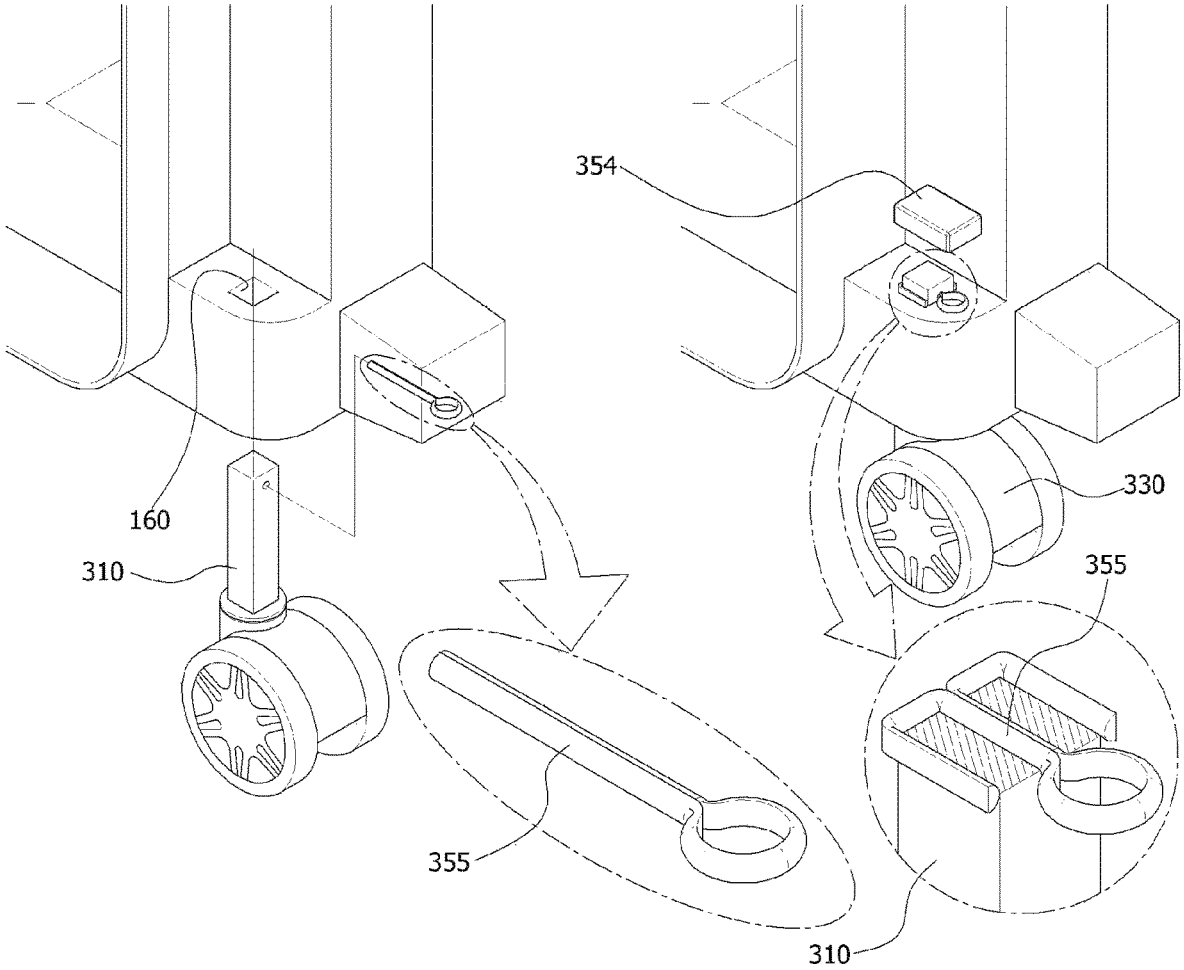

As shown in FIG. 7, the coupling member 350 is configured such that a pin hole is formed through the fixing boss 310 and the fixing pin 355 is inserted into the pin hole to fix the fixing boss 310 in the support hole 160. Accordingly, it is possible to easily separate the fixing boss 310 from the support hole 160 merely by separating the fixing pin 355 from the pin hole using a separate tool.

As shown in FIG. 8, the coupling member 350 is configured such that a ring hole is formed in the peripheral surface of the fixing boss 310 and the fixing cap 359 is forcibly fitted into the ring hole to fix the fixing boss 310 in the support hole 160. Accordingly, it is possible to easily separate the fixing boss 310 from the support hole 160 merely by separating the fixing cap 359 from the ring hole.

As described above, the coupling member 350 of the present invention is easily coupled to and separated from the fixing boss 310 in various coupling manners, thereby enabling rapid replacement of the caster 300.

The positioning projection 312 formed on the peripheral surface of the fixing boss 310 is inserted into and supported by the positioning hole 356 formed under the support hole 160 so as to be prevented from rotating. Accordingly, it is possible to prevent the fixing boss 310 from rotating in the support hole 160 when the coupling member 350 is coupled to and separated from the fixing boss 310.

In addition, the guide ring 358 disposed on the upper end of the support hole 160 prevents damage to the support hole 160 due to friction with the fixing boss 310, and the sealing cover 354 disposed on the upper end of the fixing boss 310 prevents exposure of the fixing boss 310.

As is apparent from the above description, the bowling bag according to the present invention provides ease of use and maintenance, facilitates storage of a plurality of bowling balls, which are heavy objects, safely loads the bowling balls therein, easily transports the bowling balls, reliably supports the bowling balls, and prevents shaking of the bowling balls during movement of the bowling bag, thereby preventing overturn or non-smooth movement of the bowling bag.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A horizontally movable bowling bag providing ease of use and maintenance, the bowling bag comprising:

a frame having a space defined therein to store a plurality of bowling balls;

a ball support assembled to or integrally formed with the frame to support each of the plurality of bowling balls in the space;

a plurality of casters provided at a lower side of the frame to allow the frame to move in a horizontal direction, each of the plurality of casters comprising a coupling member removably coupled thereto so as to be exposed to an outside of the frame, a fixing boss fixed in a support hole in the frame using the coupling member, and a drive wheel coupled to a lower end of the fixing boss so as to be freely rotatable; and a handle integrally coupled to one side of the frame, the handle being configured to be adjustable in length, wherein the frame has a plurality of support sections integrally formed therewith, each of the plurality of support sections having a predetermined height and a predetermined width to disperse load applied to the fixing boss inserted into the support hole in a vertical direction and a horizontal direction, the support hole being formed through each of the plurality of support sections, and wherein each of the plurality of casters comprises:

a positioning projection formed on one side of the fixing boss so as to be inserted into and supported by a positioning hole formed under the support hole in order to prevent rotation of the fixing boss; and a guide ring disposed on an upper end of the support hole and formed to allow the fixing boss to be inserted thereinto in order to prevent damage to the support hole due to the fixing boss.

2. The bowling bag according to claim 1, wherein the coupling member has a configuration selected from among:

a configuration in which the fixing boss has a thread formed thereon and is fixed in the support hole through engagement of a nut with the thread;

a configuration in which the fixing boss has an elastic hook formed on an upper end thereof so as to be fixed in the support hole;

a configuration in which the fixing boss has a pin hole formed therethrough and is fixed in the support hole through insertion of a fixing pin into the pin hole;

a configuration in which the fixing boss has a ring hole formed therein and is fixed in the support hole through insertion of a fixing ring into the ring hole; and a configuration in which the fixing boss has a ring hole formed therein and is fixed in the support hole through forcible fitting of a fixing cap into the ring hole.

3. The bowling bag according to claim 1, wherein the frame is made of a plastic material and has a hexahedral shape having an open front surface or an open side surface, wherein the bowling bag further comprises a cover coupled to the frame in a sewing manner, a zipper-coupling manner, a rivet-coupling manner, a screw-coupling manner, or a button-coupling manner, the cover being made of a fabric material, the cover having a pocket and a door formed corresponding to the open front surface or the open side surface of the frame, wherein the frame further comprises a storage chamber, wherein each of the plurality of support sections of the frame is formed by protruding one side of a lower portion of the frame outwards or is formed on an outer corner of the lower portion of the frame, and wherein the storage chamber is integrally formed with the frame so as to be defined in the frame or is formed so as to be mounted in the frame and to have a chamber door configured to be opened and closed from outside of the frame.

4. The bowling bag according to claim 1, further comprising an auxiliary bag comprising:

an auxiliary frame configured to store one or more bowling balls therein, the auxiliary frame being made of a plastic material;

a bracket coupled to the auxiliary frame, the bracket having a mounting hole formed therein to allow the handle to pass therethrough in a vertical direction; and an auxiliary cover connected to the auxiliary frame, the auxiliary cover having a door configured to be opened and closed from above or doors configured to be opened and closed from both sides of the auxiliary cover, the auxiliary cover being made of a fabric material.

5. The bowling bag according to claim 1, wherein the ball support comprises a shaking prevention member to prevent shaking of a bowling ball, and wherein the shaking prevention member is implemented as at least one selected from among:

a tension portion formed by cutting a portion of the ball support along an incision line, the tension portion having a protrusion formed on an upper surface thereof;

a support belt formed to be fastened and released in order to prevent the bowling ball from escaping from the ball support in a forward direction; and a resilient support member provided on an inner side of a cover coupled to the frame.

6. A horizontally movable bowling bag providing ease of use and maintenance, the bowling bag comprising:

a frame having a space defined therein to store a plurality of bowling balls;

a ball support assembled to or integrally formed with the frame to support each of the plurality of bowling balls in the space;

a plurality of casters provided at a lower side of the frame to allow the frame to move in a horizontal direction;

a handle integrally coupled to one side of the frame, the handle being configured to be adjustable in length; and an auxiliary bag, wherein the auxiliary bag comprises:

an auxiliary frame configured to store one or more bowling balls therein, the auxiliary frame being made of a plastic material;

a bracket coupled to the auxiliary frame, the bracket having a mounting hole formed therein to allow the handle to pass therethrough in a vertical direction; and an auxiliary cover connected to the auxiliary frame, the auxiliary cover having a door configured to be opened and closed from above or doors configured to be opened and closed from both sides of the auxiliary cover, the auxiliary cover being made of a fabric material, wherein each of the plurality of casters comprises:

a coupling member removably coupled thereto so as to be exposed to an outside of the frame;

a fixing boss fixed in a support hole in the frame using the coupling member;

a drive wheel coupled to a lower end of the fixing boss so as to be freely rotatable;

a positioning projection formed on one side of the fixing boss so as to be inserted into and supported by a positioning hole formed under the support hole in order to prevent rotation of the fixing boss; and a guide ring disposed on an upper end of the support hole and formed to allow the fixing boss to be inserted thereinto in order to prevent damage to the support hole due to the fixing boss, and wherein the frame has a plurality of support sections integrally formed therewith, each of the plurality of support sections having a predetermined height and a predetermined width to disperse load applied to the fixing boss inserted into the support hole in a vertical direction and a horizontal direction, the support hole being formed through each of the plurality of support sections.

7. The bowling bag according to claim 6, wherein the coupling member has a configuration selected from among:

a configuration in which the fixing boss has a thread formed thereon and is fixed in the support hole through engagement of a nut with the thread;

a configuration in which the fixing boss has an elastic hook formed on an upper end thereof so as to be fixed in the support hole;

a configuration in which the fixing boss has a pin hole formed therethrough and is fixed in the support hole through insertion of a fixing pin into the pin hole;

a configuration in which the fixing boss has a ring hole formed therein and is fixed in the support hole through insertion of a fixing ring into the ring hole; and a configuration in which the fixing boss has a ring hole formed therein and is fixed in the support hole through forcible fitting of a fixing cap into the ring hole.

8. The bowling bag according to claim 6, wherein the frame is made of a plastic material and has a hexahedral shape having an open front surface or two open opposite side surfaces, wherein the bowling bag further comprises a cover coupled to the frame in a sewing manner, a zipper-coupling manner, a rivet-coupling manner, a screw-coupling manner, or a button-coupling manner, the cover being made of a fabric material, the cover having a pocket and a door formed corresponding to the open front surface or each of the two open opposite side surfaces of the frame, wherein the frame further comprises a storage chamber defined therein to store bowling supplies other than a bowling ball, wherein each of the plurality of support sections of the frame is formed by protruding one side of a lower portion of the frame outwards or is formed on an outer corner of the lower portion of the frame, and wherein the storage chamber is integrally formed with the frame so as to be defined in the frame or is formed so as to be mounted in the frame and to have a chamber door configured to be opened and closed from outside of the frame.

9. The bowling bag according to claim 6, wherein the ball support comprises a shaking prevention member to prevent shaking of a bowling ball supported thereby, and wherein the shaking prevention member is implemented as at least one selected from among:

a tension portion formed by cutting a portion of the ball support along an incision line, the tension portion having a protrusion formed on an upper surface thereof;

a support belt formed to be fastened and released in order to prevent the bowling ball from escaping from the ball support in a forward direction; and a resilient support member provided on an inner side of a cover coupled to the frame.

10. A horizontally movable bowling bag providing ease of use and maintenance, the bowling bag comprising:

a frame having a space defined therein to store a plurality of bowling balls;

a ball support assembled to or integrally formed with the frame to support each of the plurality of bowling balls in the space;

a plurality of casters provided at a lower side of the frame to allow the frame to move in a horizontal direction, each of the plurality of casters comprising a fixing boss fixed in a support hole in the frame using a coupling member and a drive wheel coupled to a lower end of the fixing boss so as to be freely rotatable, the coupling member being removably coupled to the fixing boss so as to be exposed to an outside of the frame;

a handle integrally coupled to one side of the frame, the handle being configured to be adjustable in length; and an auxiliary bag, wherein the auxiliary bag comprises:

an auxiliary frame configured to store one or more bowling balls therein, the auxiliary frame being made of a plastic material;

a bracket coupled to the auxiliary frame, the bracket having a mounting hole formed therein to allow the handle to pass therethrough in a vertical direction; and an auxiliary cover connected to the auxiliary frame, the auxiliary cover having a door configured to be opened and closed from above or doors configured to be opened and closed from both sides of the auxiliary cover, the auxiliary cover being made of a fabric material, wherein the frame has a plurality of support sections integrally formed therewith, each of the plurality of support sections having a predetermined height and a predetermined width to disperse load applied to the fixing boss inserted into the support hole in a vertical direction and a horizontal direction, the support hole being formed through each of the plurality of support sections, and wherein each of the plurality of casters comprises:

a positioning projection formed on one side of the fixing boss so as to be inserted into and supported by a positioning hole formed under the support hole in order to prevent rotation of the fixing boss; and a guide ring disposed on an upper end of the support hole and formed to allow the fixing boss to be inserted thereinto in order to prevent damage to the support hole due to the fixing boss.

11. The bowling bag according to claim 10, wherein the auxiliary frame of the auxiliary bag has fixing projections protruding from a lower surface thereof and screw holes formed in the lower surface thereof, wherein the frame has grid-shaped ribs and screw holes formed in coupling bosses formed on an upper surface thereof, and wherein, when the auxiliary bag is placed on the frame, the fixing projections are supported by the grid-shaped ribs, and screws are fastened into the screw holes in the auxiliary frame and the screw holes in the frame.

12. The bowling bag according to claim 10, wherein each of the plurality of casters is removably mounted to the frame using the coupling member exposed to an outside of the frame, and wherein the coupling member has a configuration selected from among:

a configuration in which the fixing boss has a thread formed thereon and is fixed in the support hole through engagement of a nut with the thread;

a configuration in which the fixing boss has an elastic hook formed on an upper end thereof so as to be fixed in the support hole;

a configuration in which the fixing boss has a pin hole formed therethrough and is fixed in the support hole through insertion of a fixing pin into the pin hole;

a configuration in which the fixing boss has a ring hole formed therein and is fixed in the support hole through insertion of a fixing ring into the ring hole; and a configuration in which the fixing boss has a ring hole formed therein and is fixed in the support hole through forcible fitting of a fixing cap into the ring hole.

13. The bowling bag according to claim 12, wherein the frame is made of a plastic material and has a hexahedral shape having an open front surface or two open opposite side surfaces, wherein the bowling bag further comprises a cover coupled to the frame in a sewing manner, a zipper-coupling manner, a rivet-coupling manner, a screw-coupling manner, or a button-coupling manner, the cover being made of a fabric material, the cover having a pocket and a door formed corresponding to the open front surface or each of the two open opposite side surfaces of the frame, wherein the frame further comprises a storage chamber, wherein each of the plurality of support sections of the frame is formed by protruding one side of a lower portion of the frame outwards or is formed on an outer corner of the lower portion of the frame, and wherein the storage chamber is integrally formed with the frame so as to be defined in the frame or is formed so as to be mounted in the frame and to have a chamber door configured to be opened and closed from outside of the frame.

14. The bowling bag according to claim 12, wherein the ball support comprises a shaking prevention member to prevent shaking of a bowling ball, and wherein the shaking prevention member is implemented as at least one selected from among:

a tension portion formed by cutting a portion of the ball support along an incision line, the tension portion having a protrusion formed on an upper surface thereof;

a support belt formed to be fastened and released in order to prevent the bowling ball from escaping from the ball support in a forward direction; and a resilient support member provided on an inner side of a cover coupled to the frame.

* * * * *